US011208905B2

(12) United States Patent
Bhosale et al.

(10) Patent No.: US 11,208,905 B2
(45) Date of Patent: Dec. 28, 2021

(54) FAN ASSEMBLY FOR AN HVAC SYSTEM

(71) Applicant: Johnson Controls Technology Company, Auburn Hills, MI (US)

(72) Inventors: Anil V. Bhosale, District Satara (IN); Dhanunjaya R. Koka, Warangal (IN); Shubham J. Walke, Pune (IN); Atul R. Sonawane, Pune (IN); Krishna Anegundi, Pune (IN); Sethuram Parameswaran, Kochi (IN); Sachin S. Ghorpade, Navi Mumbai (IN)

(73) Assignee: Johnson Controls Technology Company, Auburn Hills, MI (US)

( * ) Notice: Subject to any disclaimer, the term of this patent is extended or adjusted under 35 U.S.C. 154(b) by 81 days.

(21) Appl. No.: 16/711,202

(22) Filed: Dec. 11, 2019

(65) Prior Publication Data

US 2020/0370441 A1 Nov. 26, 2020

Related U.S. Application Data

(60) Provisional application No. 62/852,851, filed on May 24, 2019.

(51) Int. Cl.
*F01D 7/00* (2006.01)
*F04D 29/36* (2006.01)
(Continued)

(52) U.S. Cl.
CPC ..... *F01D 7/00* (2013.01); *F04D 29/362* (2013.01); *F24F 1/06* (2013.01); *F04D 19/002* (2013.01);
(Continued)

(58) Field of Classification Search
CPC ..... F04D 29/362; F04D 19/002; F04D 25/08; F04D 27/02; F04D 29/36; F05D 2260/70; F01D 7/00; F01D 17/10; F01D 17/16
See application file for complete search history.

(56) References Cited

U.S. PATENT DOCUMENTS 2,487,836 A * 11/1949 Turnbull ..... B64C 11/36 416/155
2,986,218 A * 5/1961 Thorsell ..... F01D 7/00 416/50

(Continued)

FOREIGN PATENT DOCUMENTS

GB 754852 A 8/1956

OTHER PUBLICATIONS

Blade Pitch System—Pitch control using a push rod; https://www.youtube.com/watch?v=tNWVaKjLLyA; Published Sep. 3, 2016; Publisher Pengpeng Cao (1:48 minutes).

*Primary Examiner* — Richard A Edgar
*Assistant Examiner* — Jackson N Gillenwaters
(74) *Attorney, Agent, or Firm* — Fletcher Yoder, P.C.

(57) ABSTRACT

A fan assembly for a heating, ventilation, and/or air conditioning (HVAC) unit includes a hub having a fan blade extending therefrom. The fan assembly includes a fan pitch adjuster configured to engage the fan blade and to adjust a pitch of the fan blade relative to the hub in response to movement of the fan pitch adjuster relative to the hub. The fan assembly also includes a motor shaft coupled to the fan pitch adjuster and to the hub, where the motor shaft is configured to drive rotation of the fan pitch adjuster and the hub. The fan assembly further includes an actuator coupled to the fan pitch adjuster and configured to axially move the fan pitch adjuster along the motor shaft and relative to the hub to adjust the pitch of the fan blade.

25 Claims, 20 Drawing Sheets

(51) Int. Cl.
*F24F 1/06* (2011.01)
*F04D 27/00* (2006.01)
*F04D 19/00* (2006.01)

(52) U.S. Cl.
CPC ..... *F04D 27/00* (2013.01); *F05D 2240/60* (2013.01); *F05D 2260/70* (2013.01)

(56) References Cited

U.S. PATENT DOCUMENTS

| | | | | |
|---|---|---|---|---|
| 5,174,716 | A * | 12/1992 | Hora | F01D 7/00 416/26 |
| 5,564,899 | A | 10/1996 | Na | |
| 6,113,351 | A * | 9/2000 | McCallum | F04D 29/063 123/41.49 |
| 6,592,328 | B1 | 7/2003 | Cahill | |
| 7,568,888 | B2 | 8/2009 | Castillo | |
| 8,231,345 | B2 * | 7/2012 | Robinson | B60K 11/04 416/39 |
| 8,622,705 | B2 | 1/2014 | Bornay Rico et al. | |
| 9,835,037 | B2 | 12/2017 | Goerig et al. | |
| 10,371,155 | B2 * | 8/2019 | Hagele | F04D 19/005 |
| 2016/0025102 | A1 | 1/2016 | Benevelli et al. | |
| 2017/0058683 | A1 | 3/2017 | Niergarth et al. | |
| 2017/0218974 | A1 | 8/2017 | Grice | |
| 2019/0017396 | A1 | 1/2019 | Lopez Guzman et al. | |
| 2019/0353042 | A1 * | 11/2019 | West | F03D 9/35 |

* cited by examiner

FAN ASSEMBLY FOR AN HVAC SYSTEM

CROSS-REFERENCE TO RELATED APPLICATIONS

This application claims priority from and the benefit of U.S. Provisional Application Ser. No. 62/852,851, entitled "FAN ASSEMBLY FOR AN HVAC SYSTEM," filed May 24, 2019, which is herein incorporated by reference in its entirety for all purposes.

BACKGROUND

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light and not as an admission of any kind.

A heating, ventilation, and/or air conditioning (HVAC) system may be used to thermally regulate an environment, such as a space within a building, home, or other structure. The HVAC system generally includes a vapor compression system that includes heat exchangers, such as a condenser and an evaporator, which cooperate to transfer thermal energy between the HVAC system and the environment. In many cases, a fan, such as an axial fan, is configured to direct an air flow across a heat exchanger of the HVAC system. For example, the fan typically includes a motor configured to rotate a fan hub about a central axis of the fan. A plurality of angled fan blades extends radially from the fan hub, such that rotation of the fan blades generates an air flow from an upstream end of the fan to a downstream end of the fan. Unfortunately, conventional fans may be unable to efficiently adjust an air flow rate across the heat exchanger in response to changes in operational parameters of the HVAC system, thereby reducing an overall operational efficiency of the HVAC system.

SUMMARY

The present disclosure relates to a fan assembly for a heating, ventilation, and/or air conditioning (HVAC) unit. The fan assembly includes a hub having a fan blade extending therefrom. The fan assembly also includes a fan pitch adjuster configured to engage the fan blade and to adjust a pitch of the fan blade relative to the hub in response to movement of the fan pitch adjuster relative to the hub. The fan assembly also includes a motor shaft coupled to the fan pitch adjuster and to the hub, where the motor shaft is configured to drive rotation of the fan pitch adjuster and the hub. The fan assembly further includes an actuator coupled to the fan pitch adjuster and configured to axially move the fan pitch adjuster along the motor shaft and relative to the hub to adjust the pitch of the fan blade.

The present disclosure also relates to a fan assembly for a heating, ventilation, and/or air conditioning (HVAC) unit that includes a hub having a rotational axis and a fan blade extending from the hub. The fan assembly includes a motor shaft coupled to the hub and configured to drive rotation of the hub about the rotational axis. The fan assembly also includes a fan pitch adjuster disposed about the motor shaft and configured to engage with the fan blade to adjust a pitch of the fan blade relative to the hub in response to movement of the fan pitch adjuster along the motor shaft. The fan assembly further includes an actuator coupled to the fan pitch adjuster and configured to drive the fan pitch adjuster along the motor shaft to adjust the pitch of the fan blade.

The present disclosure also relates to a fan assembly for a heating, ventilation, and/or air conditioning (HVAC) unit that includes a hub and a fan blade rotationally coupled to the hub, where the fan blades extends from a rotational axis of the hub. The fan assembly includes motor shaft coupled to the hub and configured to drive rotation of the hub about the rotational axis. The fan assembly also includes a fan pitch adjuster engaged with the fan blade and configured to translate along the motor shaft, where the fan pitch adjuster is configured to rotate the fan blade relative to the hub in response to movement of the fan pitch adjuster along the motor shaft such that a pitch of the fan blade is adjusted. The fan assembly further includes an actuator coupled to the fan pitch adjuster and configured to induce the movement of the fan pitch adjuster along the motor shaft.

BRIEF DESCRIPTION OF THE DRAWINGS

Various aspects of this disclosure may be better understood upon reading the following detailed description and upon reference to the drawings in which.

DETAILED DESCRIPTION

Figure 1:
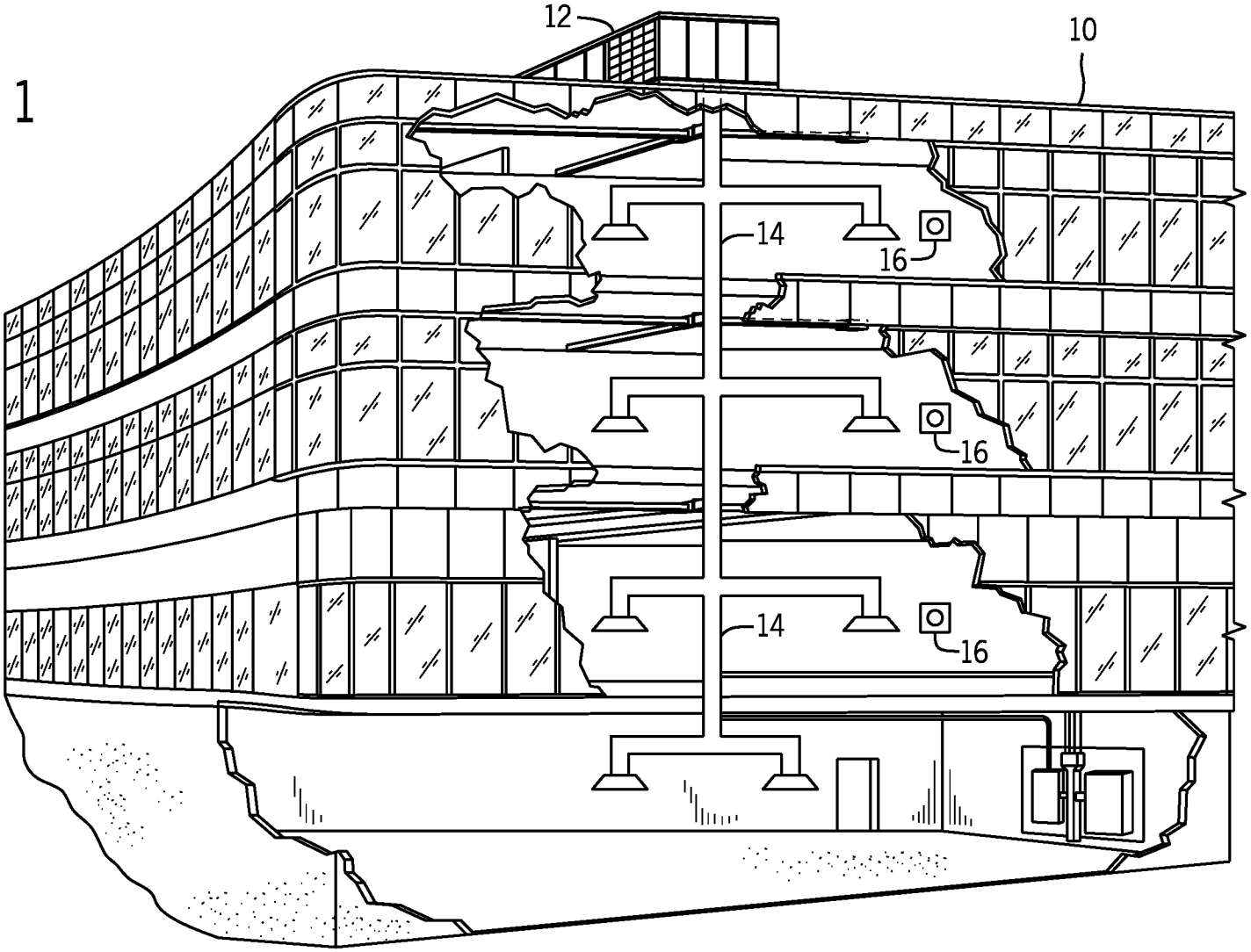
FIG. 1 is a perspective view of an embodiment of a building that may utilize a heating, ventilation, and/or air conditioning (HVAC) system in a commercial setting, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As briefly discussed above, a heating, ventilation, and/or air conditioning (HVAC) system may include one or more fans that are configured to direct an air flow across certain components of the HVAC system, such as a condenser and/or an evaporator. Typical fans include an actuator, such as an electric motor, which is configured to rotate a central fan hub about a central axis of the fan. A plurality of fan blades extends radially from the fan hub, relative to the central axis, such that rotation of the fan hub drives rotation of the fan blades about the central axis. The fan blades generally include an angled blade member having a pressure surface and a suction surface that is disposed opposite the pressure surface. Rotation of the fan enables the pressure surface of the fan blades to engage with ambient air surrounding the fan to generate an air flow generally along the central axis of the fan from an upstream end to a downstream end of the fan.

Typical fans often include a variable frequency drive (VFD) that is electrically coupled to the fan actuator and is configured to regulate an operational speed of the actuator. Accordingly, by adjusting a speed of the fan actuator, the VFD may be used to adjust a flow rate of the air flow generated by the fan. Unfortunately, VFDs may be relatively expensive to install or replace, and thus, may increase overall installation costs and/or maintenance costs associated with the HVAC system.

It is now recognized that enabling adjustability of an air flow rate generated by a fan without utilization of a VFD may reduce an assembly cost and/or operational cost of the fan and the overall HVAC system. Moreover, it is now recognized that enabling adjustability in an air flow rate generated by the fan without adjusting an operational speed of the fan may enable the use of relatively inexpensive single speed electric motors to drive operation of the fan.

Accordingly, embodiments of the present disclosure are directed to a fan assembly having a fan pitch adjuster that is operable to selectively transition a plurality of fan blades to various pitch angles to enable adjustment of an air flow rate generated by the fan blades without increasing or decreasing an operational speed of the fan assembly. For example, in some embodiments, the fan assembly may include an actuator, such as an electric motor, that is configured to drive rotation of the fan blades about a central axis of the fan assembly at a particular rotational speed. The fan assembly may include an additional actuator that is engaged with each of the fan blades via the fan pitch adjuster and is configured to adjust a respective pitch angle of the fan blades relative to a plane of rotation of the fan hub. That is, the additional actuator may selectively adjust the pitch angles of the fan blades to enable the fan blades to engage with a larger amount or a lesser amount of the ambient air surrounding the fan assembly. Accordingly, the additional actuator may increase or decrease an air flow rate generated by the fan blades without adjusting an operational speed of the fan. These and other features will be described below with reference to the drawings.

It is important to note that, while the present disclosure describes the fan assembly as configured to generate an air flow in an HVAC application, it should be appreciated that the disclosed embodiments may be implemented on other fans or flow generating devices that may be implemented in various industrial, commercial, or other settings. For example, the techniques described herein may be used to adjust pitch angles of propeller blades used in marine propulsions systems, to adjust pitch angles of fan blades used in automotive heating and cooling systems, to adjust pitch angles of turbine blades used in wind turbine applications, and/or to adjust pitch angles of fan blades or propeller blades included in a variety of other flow generating devices.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
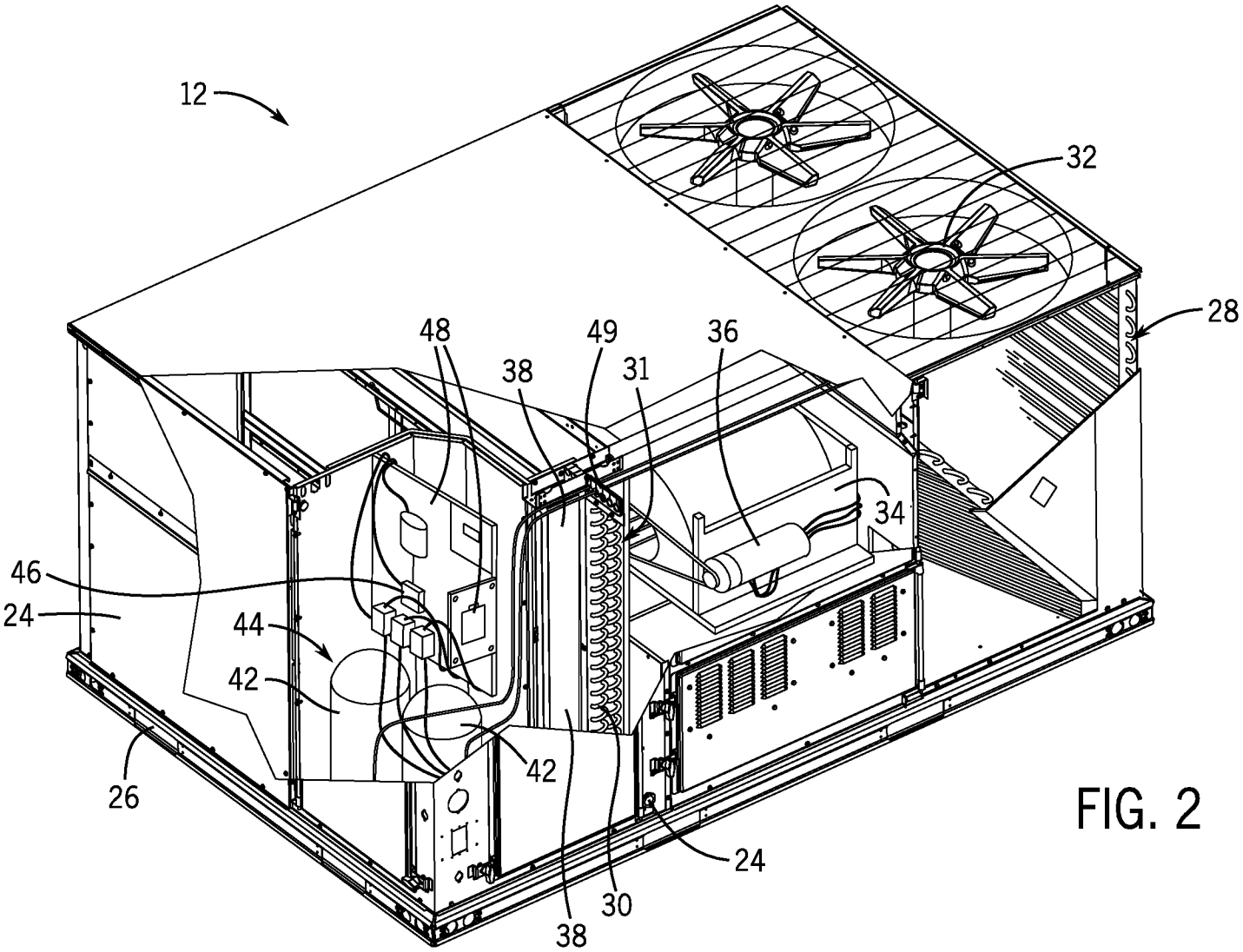
FIG. 2 is a perspective view of an embodiment of a packaged HVAC unit, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
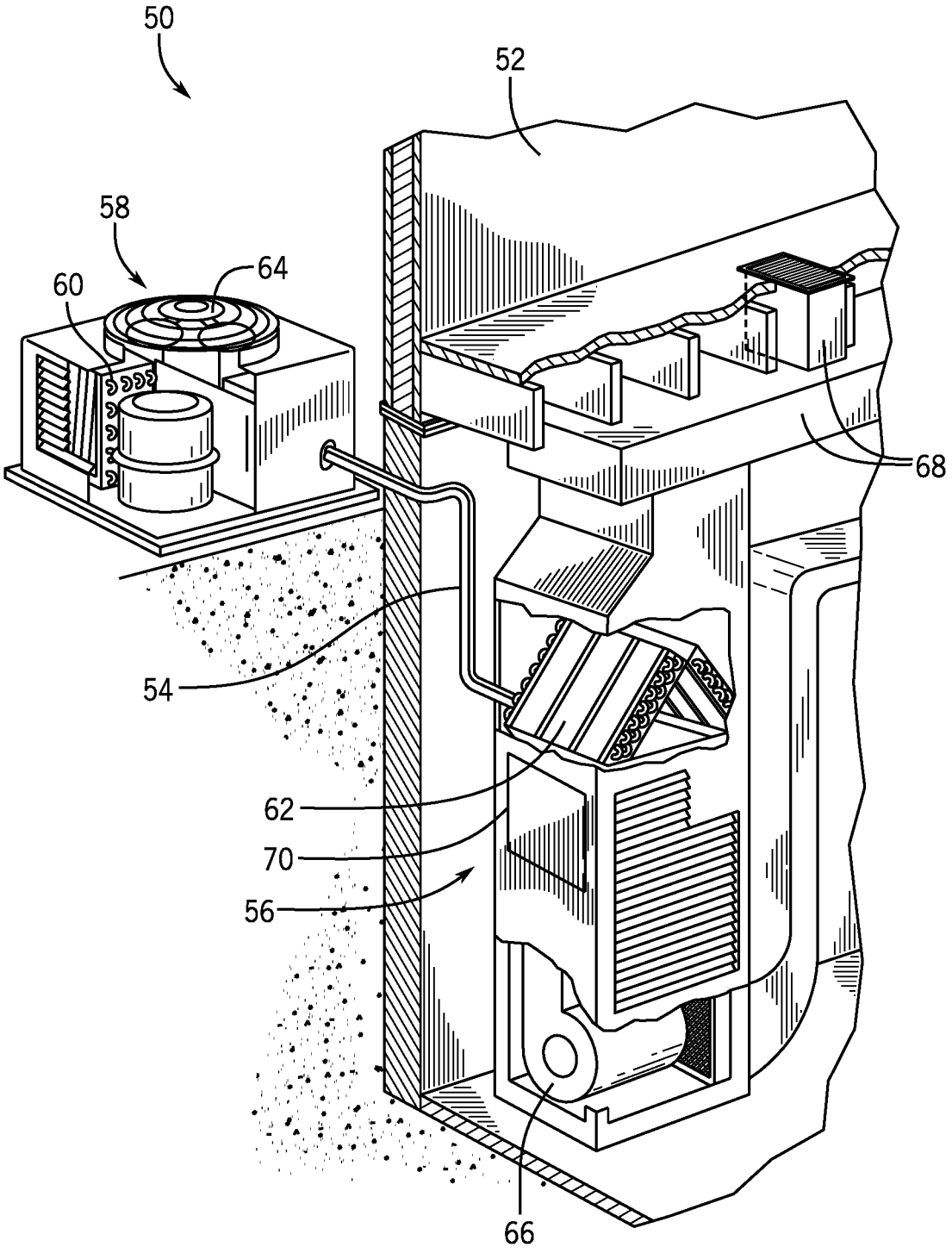
FIG. 3 is a perspective view of an embodiment of a split, residential HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit 56 functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or a set point plus a small amount, the residential heating and cooling system 50 may become operative to refrigerate additional air for circulation through the residence 52. When the temperature reaches the set point, or a set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace system 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
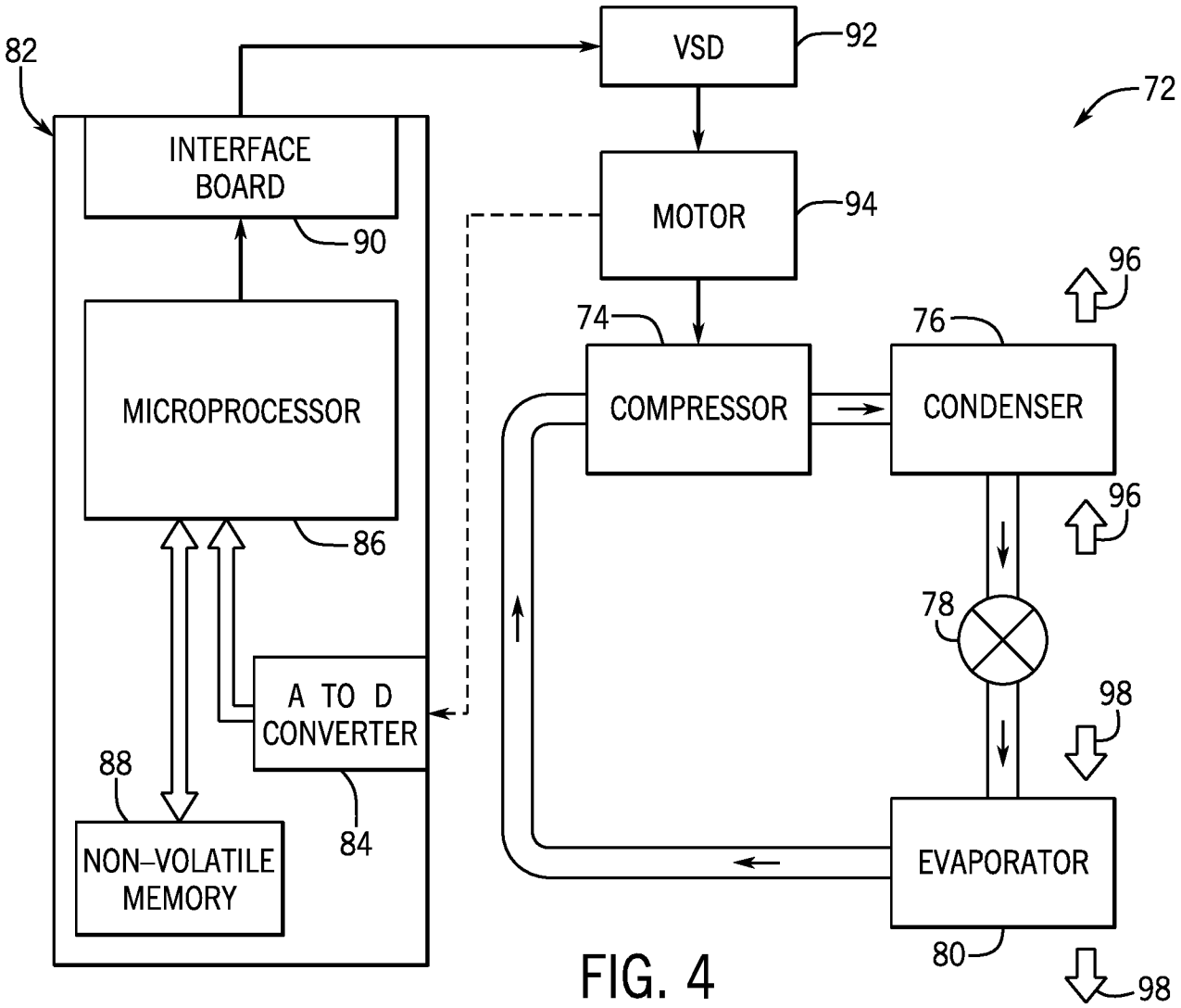
FIG. 4 is a schematic diagram of an embodiment of a vapor compression system that may be used in an HVAC system, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

Figure 5:
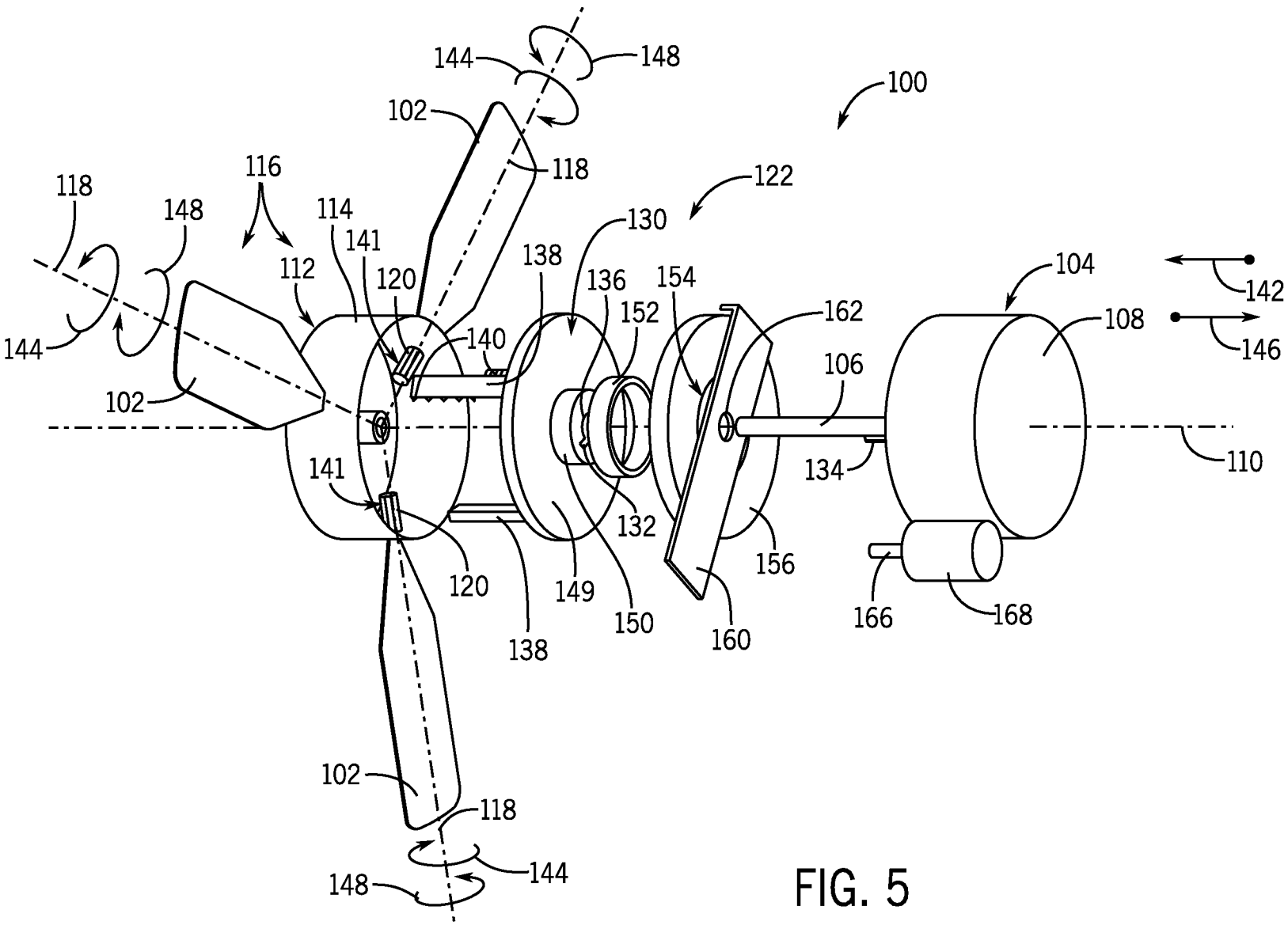
FIG. 5 is an exploded perspective view of an embodiment of a fan assembly for an HVAC system, in accordance with an aspect of the present disclosure.

As noted above, embodiments of the present disclosure are directed to a fan assembly having fan blades that are adjustable to various pitch angles to increase or decrease a flow rate of an air flow that may be generated by the fan assembly. To facilitate the following discussion, FIG. 5 is a perspective view of an embodiment of a fan assembly 100 that enables adjustment of pitch angles of one or more fan blades 102. It should be appreciated that the fan assembly 100 may be included embodiments or components of the HVAC unit 12 shown in FIGS. 1 and 2, embodiments or components of the split residential heating and cooling system 50 shown in FIG. 3, a rooftop unit (RTU), or any other suitable air handling unit or HVAC system. Moreover, as noted above, it should be understood that the fan assembly 100 may be implemented in any other application or technological field where pitch adjustment of fan blades or propeller blades is desired. For example, embodiments of the fan assembly 100 discussed herein may be implemented in automotive systems, fire suppression systems, wind turbine systems, hydroelectric systems, or other suitable systems.

In the illustrated embodiment, the fan assembly 100 includes an actuator 104, also referred to herein as a motor, which is configured to drive rotation of a motor shaft 106 relative to a housing 108 of the actuator 104. In particular, the actuator 104 is configured to rotate the motor shaft 106 about an axis 110, which extends collinear with the motor shaft 106. The actuator 104 may include an electric motor, a hydraulic motor, a pneumatic motor, or any other suitable actuator that is configured to drive rotation of the motor shaft 106 about the axis 110. The motor shaft 106 is coupled to a fan hub 112, thereby enabling the actuator 104 to induce rotational motion to the fan hub 112 about the axis 110 via the motor shaft 106. The fan hub 112 may be coupled to the motor shaft 106 via suitable fasteners, such as bolts, friction pins, and/or rivet connectors, via adhesives, such as bonding glue, and/or via a metallurgical process, such as welding or brazing. In any case, the fan hub 112 may be affixed to the motor shaft 106 to block rotational motion and translational movement of the fan hub 112 relative to the motor shaft 106. Accordingly, the fan hub 112 may rotate about the axis 110 relative to the housing 108, while translational movement of the fan hub 112 along the axis 110 relative to the housing 108 is substantially blocked.

The fan hub 112 includes the fan blades 102 which may extend radially from an outer ring or surface 114 of the fan hub 112. The fan hub 112 and the fan blades 102 may be collectively referred to herein as a fan 116 of the fan assembly 100. The fan blades 102 may be rotatably coupled to the outer ring 114 or to another suitable portion of the fan hub 112 to enable rotation of the fan blades 102 relative to the fan hub 112. For example, in some embodiments, one or more apertures may be formed within the outer ring 114 and may be configured to receive suitable bushings or bearings that enable rotation of the fan blades 102 relative to the fan hub 112. Accordingly, each of the fan blades 102 may be rotatable about a respective rotational axis 118 that extends along the fan blade 102 and generally orthogonal or generally cross-wise to the axis 110. Although the fan assembly 100 includes three fan blades 102 in the illustrated embodiment, it should be noted that, in other embodiments, the fan assembly 100 may include any suitable number of fan blades 102 extending from the fan hub 112. For example, in some embodiments, the fan assembly 100 may include 1, 2, 3, 4, 5, 6, or more than six fan blades that are rotatably or pivotably coupled to the fan hub 112, in accordance with the techniques discussed herein.

Each of the fan blades 102 may be coupled to a respective pinion 120, also referred to herein as a first gear, which is configured to facilitate selectively actuatable rotational motion of the fan blades 102 about the axes 118. Particularly, as discussed in detail below, the pinions 120 are configured to engage with a fan pitch adjuster 122 that is operable to adjust a pitch of the fan blades 102 via the engagement with the pinions 120. For clarity, as used herein, a "pitch" of the fan blades 102 may refer to a rotational position of each of the fan blades 102, with respect the axes 118, relative to the fan hub 112 and/or relative to a plane in which the fan hub 112 and the fan blades 102 rotate. As will be appreciated, the rotational plane may be defined by the axes 118. Current rotational positions of the fan blades 102, relative to the fan hub 112, may be referred to herein as "pitch angles" of the fan blades 102. By enabling adjustment of the pitch angles of the fan blades 102, the fan pitch adjuster 122 may be used to adjust a flow rate and/or a flow direction of a fluid flow that may be generated by the fan assembly 100.

In the illustrated embodiment, the fan pitch adjuster 122 includes a first plate 130 that is configured to engage with the motor shaft 106 in a manner that blocks rotational motion of the first plate 130 relative to the motor shaft 106 while enabling the first plate 130 to translate axially along the motor shaft 106. For example, in some embodiments, the first plate 130 may include a first retention feature 132, such as a keyway, which is configured to engage with a second retention features 134, such as a key, extending from the motor shaft 106. Specifically, the motor shaft 106 may be configured to extend through an aperture 136 formed within the first plate 130 to enable the first retention feature 132 to engage with the second retention feature 134. In this manner, the engagement between the first and second retention features 132, 134 may enable the first plate 130 to translate axially along the motor shaft 106, relative to the fan hub 112, while rotational motion of the first plate 130 relative to the fan hub 112 is substantially blocked. Accordingly, the actuator 104 may, via the motor shaft 106, impart rotational motion to the first plate 130 about the axis 110.

The first plate 130 includes one or more racks 138, also referred to herein as second gears, which extend from the first plate 130 along the axis 110 and which are configured to engage with corresponding ones of the pinions 120. Specifically, the racks 138 may each include a toothed track 140, which is configured to engage with teeth 141 of a corresponding pinion 120. As discussed below, the engagement between the racks 138 and the pinions 120 may enable axial movement of the first plate 130 along the motor shaft 106 to be converted to rotational motion of the fan blades 102 about the axes 118. For example, axial movement of the first plate 130 along the motor shaft 106 in a first translation direction 142, toward the fan hub 112, may enable the racks 138 to rotate the fan blades 102 about their corresponding axes 118 in a first rotational direction 144. Conversely, axial movement of the first plate 130 along the motor shaft 106 in a second translational direction 146, away from the fan hub 112, may enable the racks 138 to rotate the fan blades 102 about their corresponding axes 118 in a second rotational direction 148 that is opposite to the first rotational direction 144. Accordingly, via translational movement along the motor shaft 106, the first plate 130 may adjust the pitch angles of the fan blades 102. In some embodiments, respective springs may be positioned between the fan hub 112 and ends of the racks 138 to bias the racks 138 in the second translational direction 146.

It should be appreciated that, in some embodiments, the first plate 130 may be a single piece component that includes the racks 138 and the toothed tracks 140. For example, the first plate 130 may be constructed of a polymeric material and formed via an injection molding process or an additive manufacturing process. In certain embodiments, the first plate 130 may be formed from individual subcomponents that are coupled together to form the first plate 130. For example, the first plate 130 may include a plate body 149 that is configured to couple to the racks 138 via suitable fasteners or adhesives.

In some embodiments, the first plate 130 may include a protrusion 150, such as a cylindrical protrusion, which is configured to engage with a bearing 152 of the fan pitch adjuster 122. That is, the protrusion 150 may be configured to couple to an inner race of the bearing 152 via, for example, an interference fit, via an adhesive, or via engagement between a retention feature of the protrusion 150 and a retention feature of the inner race of the bearing 152. The bearing 152 may be received by an aperture 154 formed within a second plate 156 of the fan pitch adjuster 122. Specifically, an outer race of the bearing 152 may be configured to couple to the second plate 156 in a similar manner to the engagement between the protrusion 150 and the inner race of the bearing 152.

Accordingly, the bearing 152 may be disposed about the motor shaft 106 and positioned radially between the first plate 130 and the second plate 156, such that the bearing 152 may rotatably couple the first plate 130 to the second plate 156. That, is the bearing 152 may be configured to block axial movement of the first plate 130 relative to the second plate 156, such as via an interference fit between the bearing 152, the first plate 130, and the second plate 156, while enabling rotational motion of the first plate 130 relative to the second plate 156. Accordingly, the second plate 156 may remain rotationally stationary, relative to the housing 108 of the actuator 104, while the motor shaft 106, the fan 116, and the first plate 130 may rotate about the axis 110 relative to the second plate 156. It should be appreciated that, in other embodiments, the bearing 152 may be replaced with a bushing. Moreover, in certain embodiments, the protrusion 150 of the first plate 130 may engage directly with the aperture 154 of the second plate 156. In such embodiments, a lubricant, such as grease or oil, may be used to reduce frictional resistance that may be generated between an outer surface of the protrusion 150 and an inner surface of the aperture 154 when the first plate 130 rotates relative to the second plate 156.

As shown in the illustrated embodiment, the fan pitch adjuster 122 may include a third plate 160, which may be coupled to the second plate 156 via suitable fasteners, adhesives, or a metallurgical process. However, it should be appreciated that, in other embodiments, the third plate 160 may be formed integrally with the second plate 156. In any case, the third plate 160 may include an aperture 162 formed therein that enables the motor shaft 106 to extend through the third plate 160. Accordingly, the third plate 160 may be disposed about the motor shaft 106.

The third plate 160 may be configured to engage with an actuating member 166, such as a rod or a shaft, of an additional actuator 168. The additional actuator 168 may include, for example, a linear actuator, which is configured to extend the actuating member 166 in the first translational direction 142 and to retract the actuating member 166 in the second translational direction 146. Accordingly, the additional actuator 168 may be used to translate the fan pitch adjuster 122 along the motor shaft 106 in the first translational direction 142 or in the second translational direction 146, thereby enabling the racks 138 to rotate the fan blades 102 about their corresponding axes 118 in the first rotational direction 144 or the second rotational direction 148, respectively. In some embodiments, the additional actuator 168 may be coupled to the housing 108 of the actuator 104, such that the additional actuator 168 is stationary relative to the housing 108. As such, the additional actuator 168 may be configured to remain rotationally stationary relative to the second plate 156. That is, the second plate 156 may translate along the motor shaft 106 relative to the additional actuator 168, while rotational motion of the second plate 156 relative to the additional actuator 168 may be blocked via the engagement between the second plate 156 and the actuating member 166 via the third plate 160.

It should be understood that, in some embodiments, the actuating member 166 may be coupled directly to the second plate 156, such that the third plate 160 may be omitted from the fan pitch adjuster 122. Moreover, in certain embodiments, the additional actuator 168 may include any other suitable actuator that is operable to translate the fan pitch adjuster 122 along the motor shaft 106. As a non-limiting example, in some embodiments, the additional actuator 168 may include an electric motor, and the actuation member 166 may include a threaded rod that the additional actuator 168 is configured to rotate. The threaded rod may be configured to engage with a threaded fixture, such as a fastening nut, which may be coupled to the second plate 156 or to the third plate 160. Accordingly, the engagement between the threaded fixture and the threaded rod may enable the additional actuator 168, via rotation of the threaded rod, to translate the fan pitch adjuster 122 along the motor shaft 106. As one of ordinary skill in the art will appreciate, various other actuators may be used to enable translational movement of the fan pitch adjuster 122 along the motor shaft 106.

Figure 6:
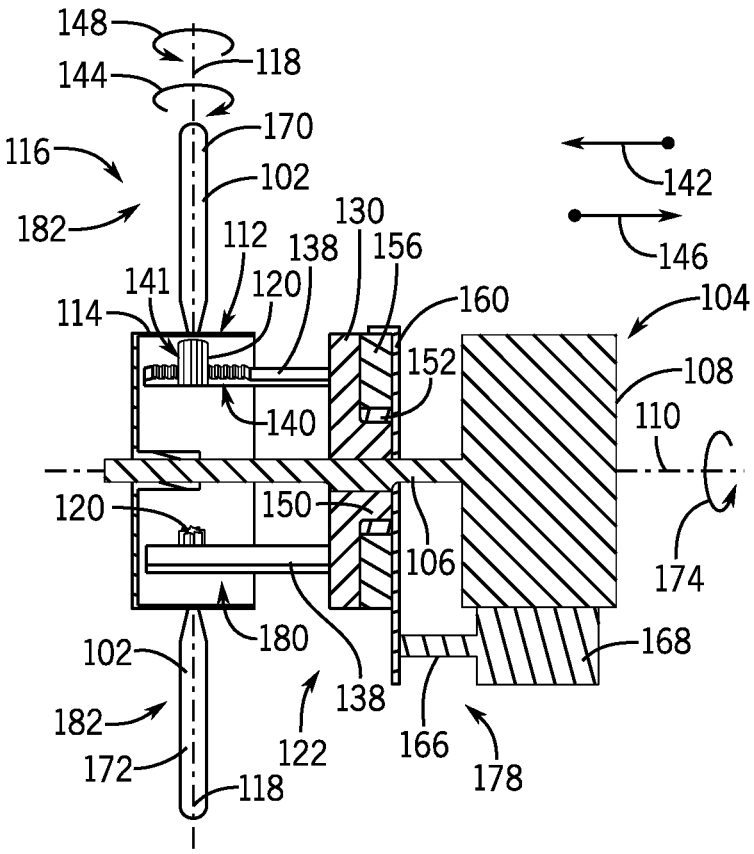
FIG. 6 is a cross-sectional side view of an embodiment of a fan assembly for an HVAC system, in accordance with an aspect of the present disclosure.

FIG. 6 is a cross-sectional side view of an embodiment of the fan assembly 100. The fan blades 102 each include a pressure surface 170, which may be oriented toward the actuator 104, and a suction surface 172, which is disposed opposite the pressure surface 170 and may be oriented away from the actuator 104. In some embodiments, the actuator 104 may be configured to rotate the fan 116 in a third rotational direction 174, such as a counter-clockwise direction, about the axis 110. Accordingly, the pressure surfaces 170 of the fan blades 102 may engage with ambient air surrounding the fan assembly 100 to generate an air flow that flows generally along the second translational direction 146.

In the illustrated embodiment, the additional actuator 168 is positioned in an extended position 178, in which the actuation member 166 has transitioned the fan pitch adjuster 122 to a proximate position 180 that is adjacent to the fan hub 112. In the proximate position 180, the fan pitch adjuster 122 may, via the engagement between the racks 138 and the pinions 120, orient the fan blades 102 in low pitch positions 182, in which respective pitch angles of the fan blades 102 are relatively small. For example, in the low pitch positions 182, the pressure surfaces 170 of the fan blades 102 may be oriented to engage with a relatively small amount of the ambient air surrounding the fan assembly 100 during rotation of the fan 116. Accordingly, when the actuator 104 rotates the fan 116 in the third rotational direction 174 at a particular speed, referred to herein as an "operational speed" of the fan assembly 100, the fan blades 102 may force a relative small or substantially negligible flow rate of air along the second translational direction 146. As shown in the illustrated embodiment, the pinions 120 and the racks 138 may be positioned within an interior of the fan hub 112.

Figure 7:
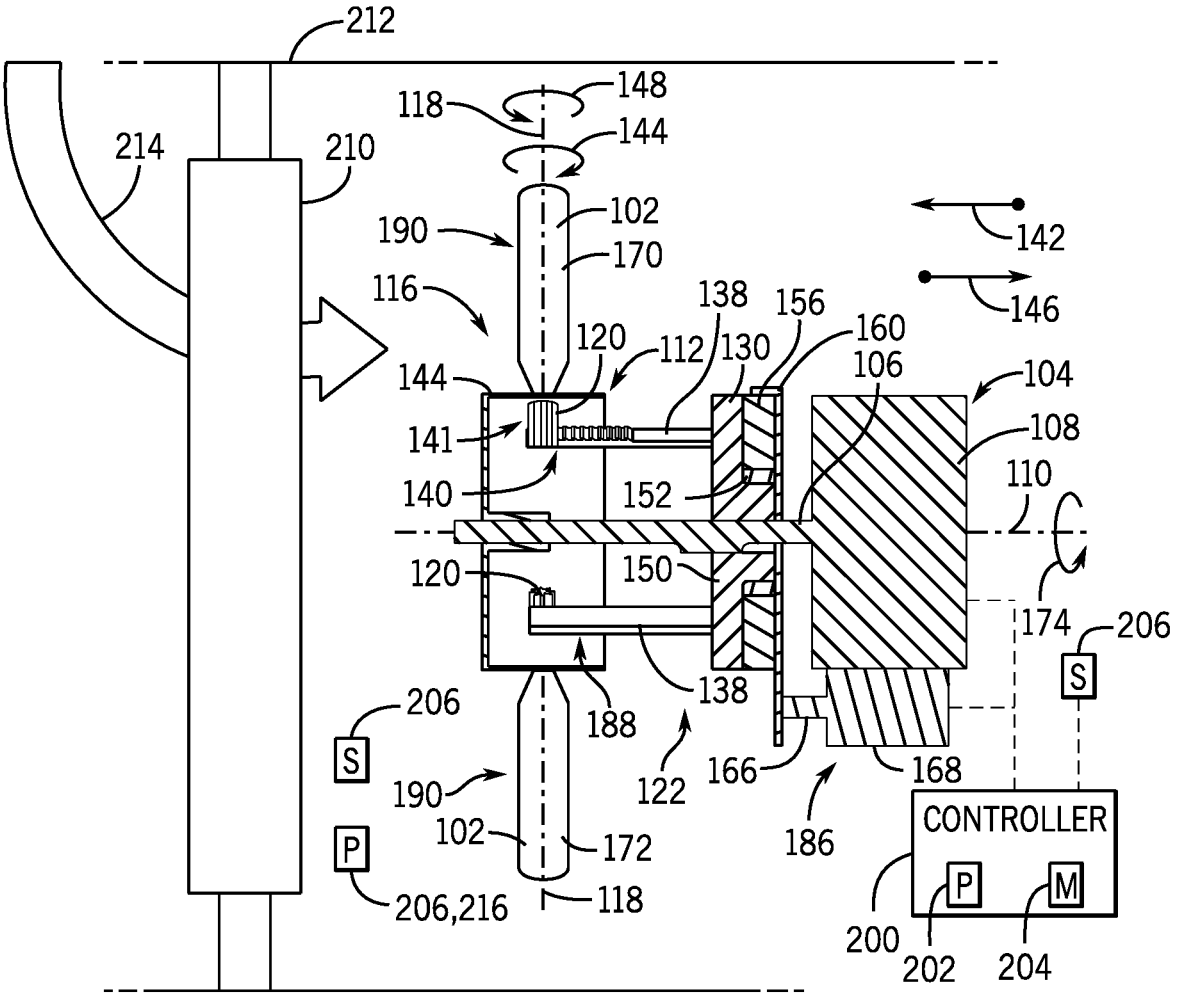
FIG. 7 is a cross-sectional side view of an embodiment of a fan assembly for an HVAC system, in accordance with an aspect of the present disclosure.

FIG. 7 is a cross-sectional side view of an embodiment of the fan assembly 100 in which the additional actuator 168 is positioned in a retracted position 186. In the retracted position 186, the additional actuator 168 has transitioned the fan pitch adjuster 122 to a distal position 188 that is distal to the fan hub 112. In the distal position 188, the fan pitch adjuster 122 may, via the engagement between the racks 138 and the pinions 120, orient the fan blades 102 in high pitch positions 190, in which respective pitch angles of the fan blades 102 are relatively large. For example, in the high pitch positions 190, the pressure surfaces 170 of the fan blades 102 may be oriented to engage with a relatively large amount of ambient air surrounding the fan assembly 100 during rotation of the fan 116. Accordingly, while the actuator 104 rotates the fan 116 in the third rotational direction 174 at the operational speed of the fan assembly 100, the fan blades 102 may force a relatively large flow rate of air along the second translational direction 146. As a non-limiting example, in some embodiments, the low pitch positions 182 and the high pitch positions 190 of the fan blades 102 may be offset from one another by approximately, 10 degrees, 20 degrees, 45 degrees, 60 degrees, or more than 60 degrees. It should be understood that, in some embodiments, translating the fan pitch adjuster 122 toward the proximate position 180 may transition the fan blades 102 toward the high pitch positions 190, while translating the fan pitch adjuster 122 toward the distal position 188 may transition the fan blades 102 toward the low pitch positions 182.

In any case, by selectively positioning the fan blades 102 at the low pitch positions 182, the high pitch positions 190, or at any position between the low pitch positions 182 and the high pitch positions 190, the additional actuator 168 may adjust an air flow rate generated by the fan assembly 100 without adjusting the operational speed of the fan assembly 100. Indeed, it should be understood that the fan pitch adjuster 122 enables adjustment of the pitch angles of the fan blades 102 during operation of the fan assembly 100 while the fan 116 rotates about the axis 110. For example, to decrease a flow rate of air generated by the fan 116 at a particular operational speed of the fan assembly 100, the additional actuator 168 may be instructed to transition the fan blades 102 toward the low pitch positions 182. To increase a flow rate of air generated by the fan 116 at a particular operational speed of the fan assembly 100, the additional actuator 168 may be instructed to transition the fan blades 102 toward the high pitch positions 190. In this manner, the fan pitch adjuster 122 may enable the fan assembly 100 to generate various air flow rates without involving modulation of an operational speed of the actuator 104 via, for example, a variable frequency drive (VFD), which may be costly to install and/or replace. Accordingly, the fan assembly 100 may reduce a production cost and/or a maintenance costs of an HVAC system, such as the HVAC unit 12, having the fan assembly 100.

It should be understood that, in certain embodiments, the fan pitch adjuster 122 may be configured to enable reversal of a flow direction of the air flow that may be generated during operation of the fan assembly 100. For example, the fan pitch adjuster 122 may be actuatable to sufficiently rotate the fan blades 102 about the axes 118 to orient the pressure surfaces 170 of the fan blades 102 away from the actuator 104 and to orient the suction surfaces 172 of the fan blades 102 toward the actuator 104. Accordingly, during rotation of the fan 116 about the axis 110 in the third rotational direction 174, the pressure surfaces 170 of the fan blades 102 function as the suction surfaces 172 of the fan blades 102, and the suction surfaces 172 of the fan blades 102 function as the pressure surfaces 170 of the fan blades 102. In this manner, the fan pitch adjuster 122 may enable the fan 116 to generate an air flow along the first translational direction 142, instead of the second translational direction 146, even when the actuator 104 rotates the fan 116 in the third rotational direction 174. Accordingly, the fan pitch adjuster 122 may be used to reverse a direction of air flow generated by the fan assembly 100 without adjusting a rotational direction of the fan 116.

In some embodiments, the actuator 104 and the additional actuator 168 may be communicatively coupled to a controller 200, such as the control panel 82, which may be used to control the actuators 104, 168 based on various operational parameters of an HVAC system having the fan assembly 100. For example, one or more control transfer devices, such as wires, cables, wireless communication devices, and the like, may communicatively couple the actuators 104, 168 and/or any other suitable components of the fan assembly 100 to the controller 200. That is, the actuators 104, 168 may each have a communication component that facilitates wired or wireless communication between the controller 200 and the actuators 104, 168 via a network. In some embodiments, the communication component may include a network interface that enables the components of the fan assembly 100, such as the actuators 104, 168, to communicate with the controller 200 via various protocols such as EtherNet/IP, ControlNet, DeviceNet, or any other communication network protocol. Alternatively, the communication component may enable the components of the fan assembly 100 to communicate with the controller 200 via mobile telecommunications technology, Bluetooth®, near-field communications technology, and the like. As such, the controller 200, the actuator 104, the additional actuator 168, and/or any other components of the fan assembly 100 may wirelessly communicate data between each other.

The controller 200 includes a processor 202, such as a microprocessor, which may execute software for controlling the actuators 104, 168 and/or other suitable components of the fan assembly 100. The processor 202 may include multiple microprocessors, one or more "general-purpose" microprocessors, one or more special-purpose microprocessors, and/or one or more application specific integrated circuits (ASICS), or some combination thereof. For example, the processor 202 may include one or more reduced instruction set (RISC) processors. The controller 200 may also include a memory device 204 that may store information such as instructions, control software, look up tables, configuration data, etc. The memory device 204 may include a volatile memory, such as random access memory (RAM), and/or a nonvolatile memory, such as read-only memory (ROM). The memory device 204 may store a variety of information and may be used for various purposes. For example, the memory device 204 may store processor-executable instructions including firmware or software for the processor 202 execute, such as instructions for controlling the actuator 104 and the additional actuator 168. In some embodiments, the memory device 204 is a tangible, non-transitory, machine-readable-medium that may store machine-readable instructions for the processor 202 to execute. The memory device 204 may include ROM, flash memory, a hard drive, or any other suitable optical, magnetic, or solid-state storage medium, or a combination thereof. The memory device 204 may store data, instructions, and any other suitable data.

In some embodiments, the controller 200 may be configured to instruct the additional actuator 168 to adjust the pitch angles of the fan blades 102 based on feedback from one or more sensors 206 that are configured to measure an operational parameter or a variety of operational parameters of an HVAC system having the fan assembly 100, such as the HVAC unit 12. As an example, in some embodiments, the fan assembly 100 may be fluidly coupled to a heat exchange area of a condenser 210, such as the condenser 76, via a flow path 212, which may be a plenum or other space defined by a housing, casing, duct, or other structure. The fan assembly 100 may be configured to draw a flow of ambient air 214 across the condenser 210 and into the flow path 212, thereby facilitating heat exchange between a refrigerant circulating through the condenser 210 and an ambient environment, such as the atmosphere. The fan assembly 100 may discharge heated ambient air 214, which has previously absorbed thermal energy form the refrigerant circulating though the condenser 210, from the flow path 212 into the ambient environment.

In some embodiments, the one or more sensors 206 may include a pressure sensor 216 that is positioned within the flow path 212 and is configured to provide the controller 200 with feedback indicative of a pressure within the flow path 212. The pressure within the flow path 212 may correspond to a flow rate of the ambient air 214 drawn across the condenser 210 by the fan assembly 100. Accordingly, the controller 200 may determine a flow rate of the ambient air 214 via the pressure feedback provided by the pressure sensor 216. In some embodiments, the controller 200 may be configured to adjust the pitch angles of the fan blades 102 to maintain a particular pressure within the flow path 212, and thus, to maintain a particular air flow rate across the condenser 210.

For example, upon receiving feedback from the pressure sensor 216 indicating that a pressure within the flow path 212 exceeds a target pressure value by a threshold amount, such as a percentage of the target value, the controller 200 may instruct the additional actuator 168 to increase the pitch angles of the fan blades 102. Accordingly, the fan 116 may engage with an increased amount of air within the flow path 212 to increase a flow rate of the air being discharged from the flow path 212. As such, the fan assembly 100 may reduce the pressure within the flow path 212 and enable the pressure within the flow path 212 to approach the target pressure value. Moreover, by reducing the pressure within the flow path 212, the fan assembly 100 may increase a flow rate of the ambient air 214 that may be forced across the condenser 210 and into the flow path 212 due to a pressure differential between the ambient environment and an interior of a structure defining the flow path 212. Conversely, upon receiving feedback from the pressure sensor 216 indicating that the pressure within the flow path 212 falls below the target pressure value by the threshold amount, the controller 200 may instruct the additional actuator 168 to decrease the pitch angles of the fan blades 102. Accordingly, the fan assembly 100 may engage with a reduced amount of air within the flow path 212 to decrease a flow rate of the air being discharged from the flow path 212. As such, the fan assembly 100 may enable the pressure within the flow path 212 to increase and approach the target pressure value. Therefore, the fan assembly 100 may decrease a flow rate of the ambient air 214 that may be forced across the condenser 210 and into the flow path 212 due to a pressure differential between the ambient environment and the interior of the structure defining the flow path 212. In accordance with these techniques, the controller 200 may adjust the pitch angles of the fan blades 102 based on a pressure within the flow path 212 to maintain a particular air flow rate across the condenser 210.

It should be appreciated that, in other embodiments, the controller 200 may be configured to adjust the pitch angles of the fan blades 102 based on a variety of other operational parameters or combination of operational parameters of an HVAC system in addition to, or in lieu of, the pressure within the flow path 212. For example, in some embodiments, the controller 200 may be configured to adjust the pitch angles of the fan blades 102 based on a temperature of refrigerant entering into or discharging from the condenser 210, based on a temperature of refrigerant entering into or discharging from the evaporator 80, based on an ambient air temperature surrounding the HVAC unit 12, based on an operational speed of the compressor 74, based on a suction or discharge temperature of the compressor 74, based on a temperature within one or more rooms or zones serviced by the HVAC unit 12, based on an operational mode of the HVAC unit 12, such as heating mode or a cooling mode of the HVAC unit 12, based on a rate of power consumption of the actuator 104, based on vibrations or perturbations of the fan 116 and/or the motor shaft 106, and/or based on any other suitable operating parameter of an HVAC system, such as the HVAC unit 12 or the split residential heating and cooling system 50, having the fan assembly 100. It should be understood that the one or more sensors 206 may include various measuring instruments that are suitably positioned and calibrated to measure any one or combination of the aforementioned operational parameters.

Figure 8:
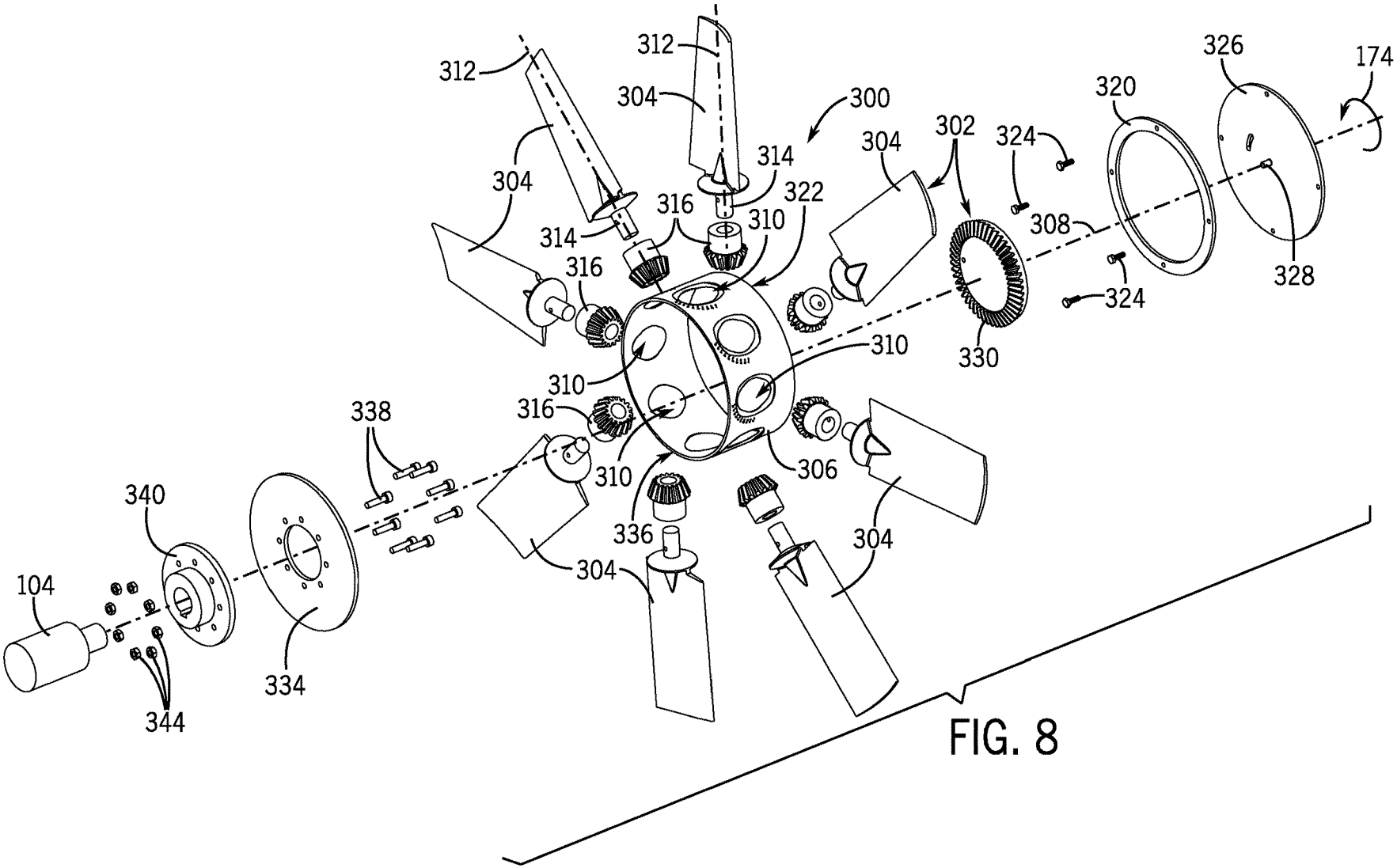
FIG. 8 is an exploded perspective view of an embodiment of a fan assembly for an HVAC system, in accordance with an aspect of the present disclosure.

FIG. 8 is an exploded perspective view of another embodiment of the fan assembly 100. In particular, the illustrated embodiment shows a fan assembly 300 that includes a gearing mechanism 302. The gearing mechanism 302 is configured to facilitate adjustment of a pitch of one or more fan blades 304 of the fan assembly 300. For example, the fan assembly 300 includes a hub ring 306 that, as discussed below, is configured to rotate about an axis 308. A plurality of apertures 310 is formed within the hub ring 306 and is configured to receive and support the fan blades 304. In particular, the apertures 310 facilitate rotatable coupling of the fan blades 304 to the hub ring 306. Accordingly, the fan blades 304 may rotate about respective centerlines 312, which may extend generally cross-wise to the axis 308, relative to the hub ring 306, while translational movement of the fan blades 304 along the centerlines 312, relative to the hub ring 306, is substantially blocked.

Each of the fan blades 304 may include a shaft portion 314 that enables the fan blades 304 to couple to respective pinions 316 of the gearing mechanism 302. As discussed below with reference to FIG. 9, the pinions 316 may be positioned within an interior of the hub ring 306 and facilitate imparting rotational motion, about the centerlines 312, to the fan blades 304. The pinions 316 may be coupled to the shaft portions 314 via suitable fasteners or adhesives. In some embodiments, in an installed configuration, the pinions 316 may be configured to block translation movement of the fan blades 304 along the centerlines 312 in directions that extend radially outward from the axis 308.

The fan assembly 300 includes an outer hub plate or ring 320 that is configured to couple to a first end portion 322 of the hub ring 306. For example, in some embodiments, a metallurgical process, such as welding, may be used to couple the outer hub plate 320 to the first end portion 322 of the hub ring 306. Upon installation of the outer hub plate 320 on the hub ring 306, suitable fasteners 324 may be used to couple an end cap 326 to the outer hub plate 320. In the illustrated embodiment, the end cap 326 includes a peg 328 that is configured to receive and support a ring gear 330 of the gearing mechanism 302. In particular, the peg 328 is configured to enable rotational motion of the ring gear 330 about the axis 308. The ring gear 330 includes a plurality of angled teeth that are configured to engage with respective angled teeth of the pinions 316. Accordingly, via the engagement between the teeth of the ring gear 330 and teeth of the pinions 316, rotational motion of the ring gear 330 about the axis 308 may be converted to rotational motion of the pinions 316, and thus the fan blades 304, about the centerlines 312. As discussed in detail below, in this manner, actuation of the ring gear 330 may be used to adjust the pitch angles of the fan blades 304.

In the illustrated embodiment, the fan assembly 300 includes an inner hub plate or ring 334 that is configured to couple to a second end portion 336 of the hub ring 306 via, for example, a welding process. Upon installation of the inner hub plate 334 on the hub ring 306, suitable fasteners 338 and retention features 344 may be used to couple an adapter flange 340 to the inner hub plate 334. It should be understood that, in some embodiments, the adapter flange 340 may be coupled to the inner hub plate 334 prior to installation of the end cap 326 on the outer hub plate 320. Accordingly, during assembly of the fan assembly 300, access may be provided to the fasteners 338 via an interior of the hub ring 306 to enable tightening of the fasteners 338 against the retention features 344. In any case, the adapter flange 340 may facilitate coupling the fan assembly 300 to a suitable actuator, such as the actuator 104. Accordingly, the adapter flange 340 enables the actuator 104 to rotate the fan assembly 300 about the axis 308 in, for example, the third rotational direction 174.

Figure 9:
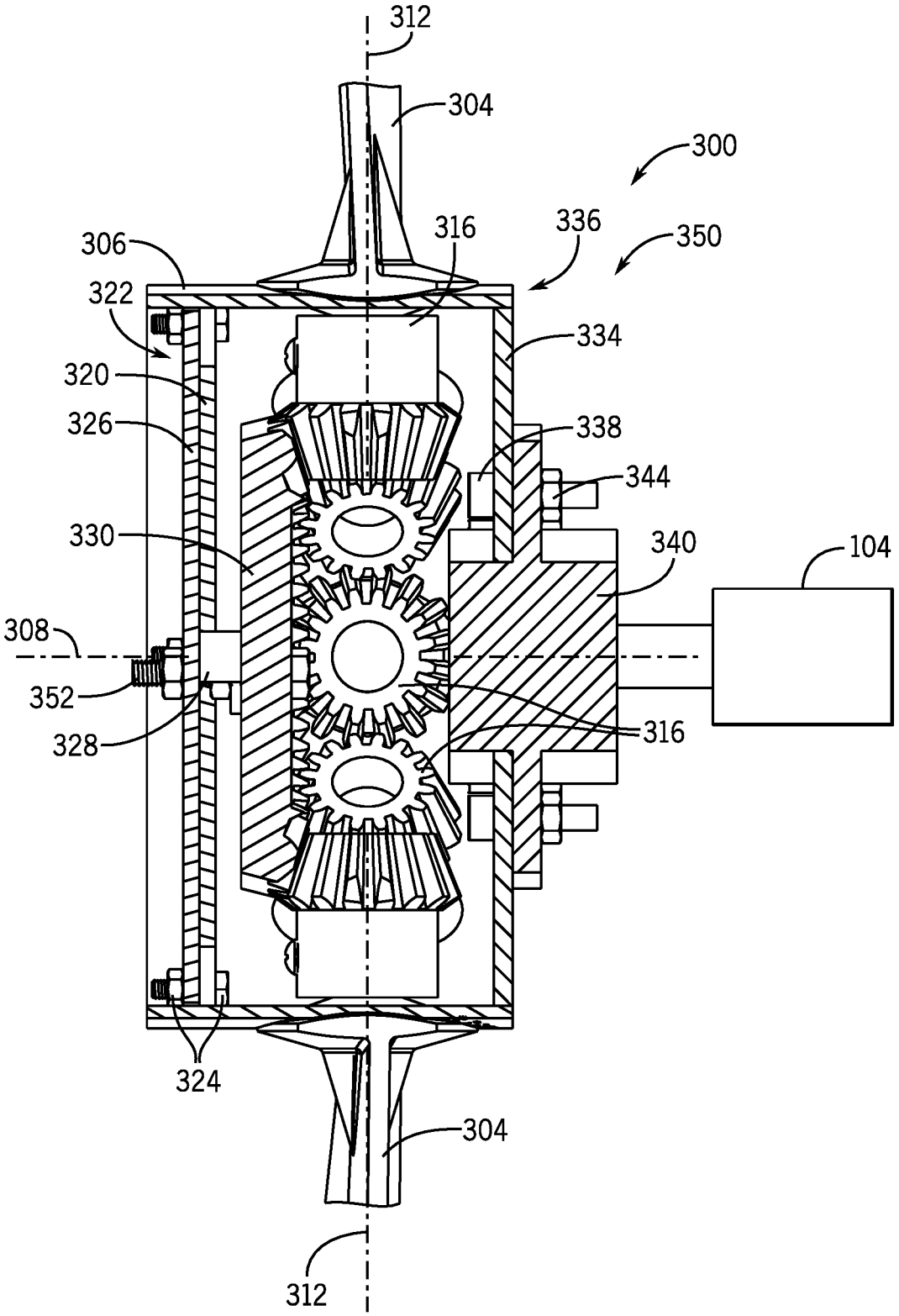
FIG. 9 is a cross-sectional side view of an embodiment of a fan assembly for an HVAC system, in accordance with an aspect of the present disclosure.
Figure 10:
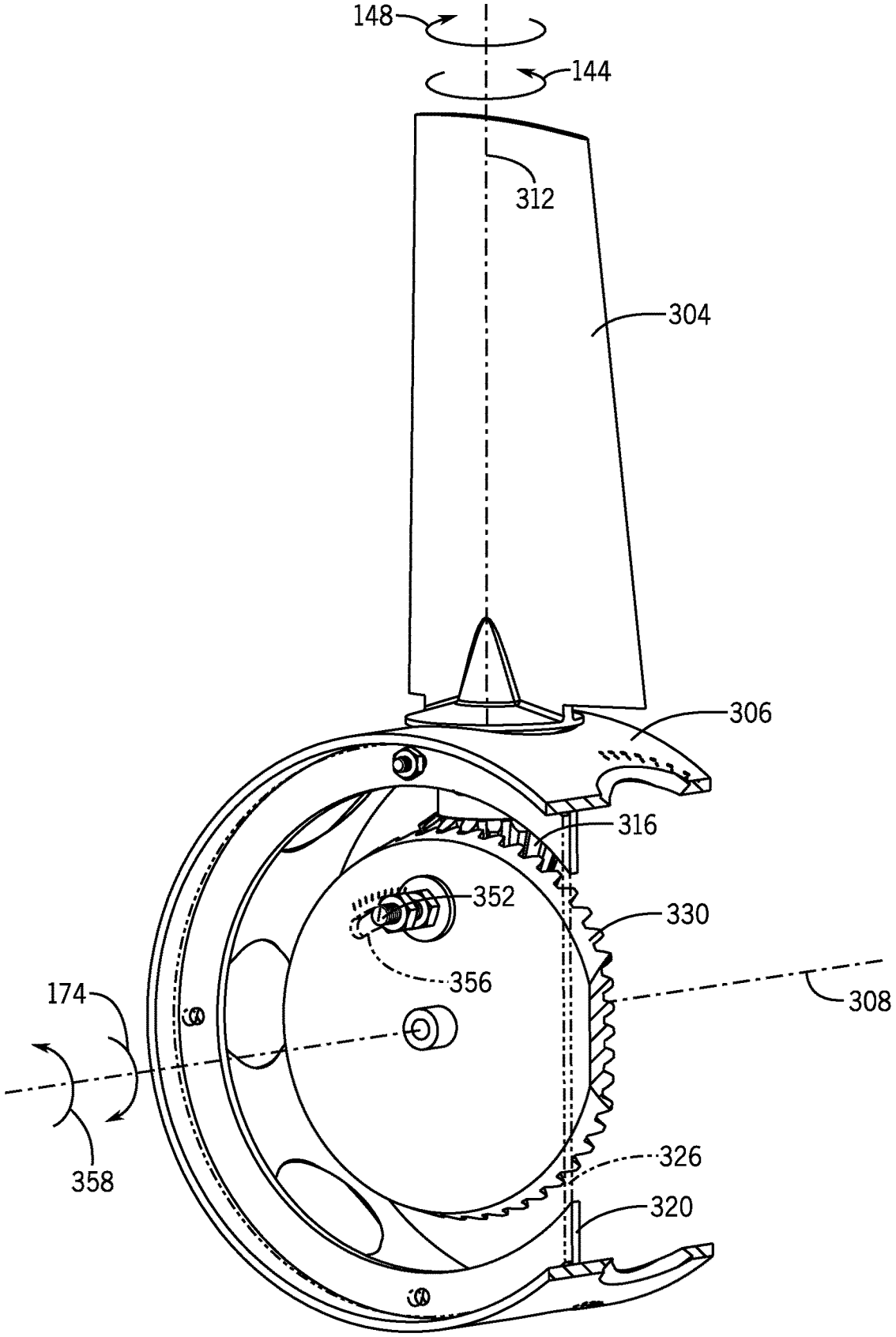
FIG. 10 is a perspective view of an embodiment of a portion of a fan assembly for an HVAC system, in accordance with an aspect of the present disclosure.

FIG. 9 is a cross-sectional side view of an embodiment of the fan assembly 300 in an assembled configuration 350. As shown in the illustrated embodiment, in the assembled configuration 350 of the fan assembly 300, the ring gear 330 engages with each of the pinions 316. Accordingly, rotational motion of the ring gear 330 about the axis 308 may enable the ring gear 330 to induce rotational motion of the pinions 316 about the centerlines 312. In some embodiments, the ring gear 330 is coupled to an adjustment feature 352 that enables an operator, such as a service technician, to selectively adjust a position of the ring gear 330 and, thus, to adjust the pitch angles of the fan blades 304. To better illustrate the engagement between the adjustment feature 352 and the ring gear 330, FIG. 10 is a front perspective view of an embodiment of a portion of the fan assembly 300. As shown in the illustrated embodiment of FIG. 10, the adjustment feature 352 extends from the ring gear 330 through a slot 356 formed within the end cap 326. Accordingly, an operator may translate the adjustment feature 352 along an arc length of the slot 356 to rotate the ring gear 330 in the third rotational direction 174 or a fourth rotational direction 358. In this manner, via the engagement between the teeth of the ring gear 330 and the teeth of the pinions 316, the operator may manually adjust the pitch angles of the fan blades 304 by rotating the ring gear 330 in the third or fourth rotational directions 174, 358. For example, rotational motion of the ring gear 330 about the axis 308 in the third rotational direction 174 may enable the ring gear 330 to induce rotation of the fan blades 304 about the centerlines 312 in the first rotational direction 144. Conversely, rotational motion of the ring gear 330 about the axis 308 in the fourth rotational direction 358 may enable the ring gear 330 to induce rotation of the fan blades 304 about the centerlines 312 in the second rotational direction 148.

Figure 11:
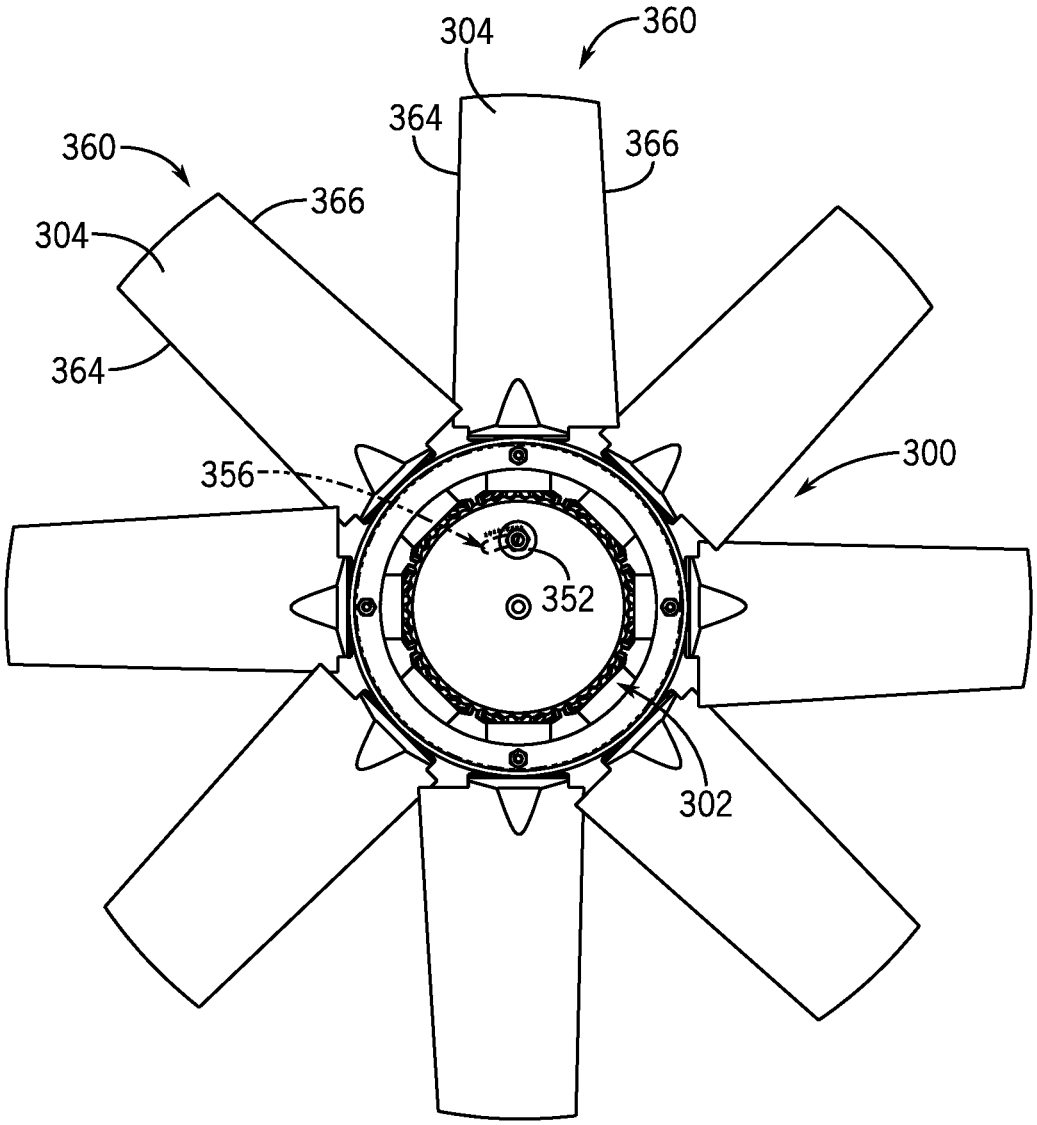
FIG. 11 is an axial view of an embodiment of a fan assembly having fan blades positioned in low pitch positions, in accordance with an aspect of the present disclosure.
Figure 12:
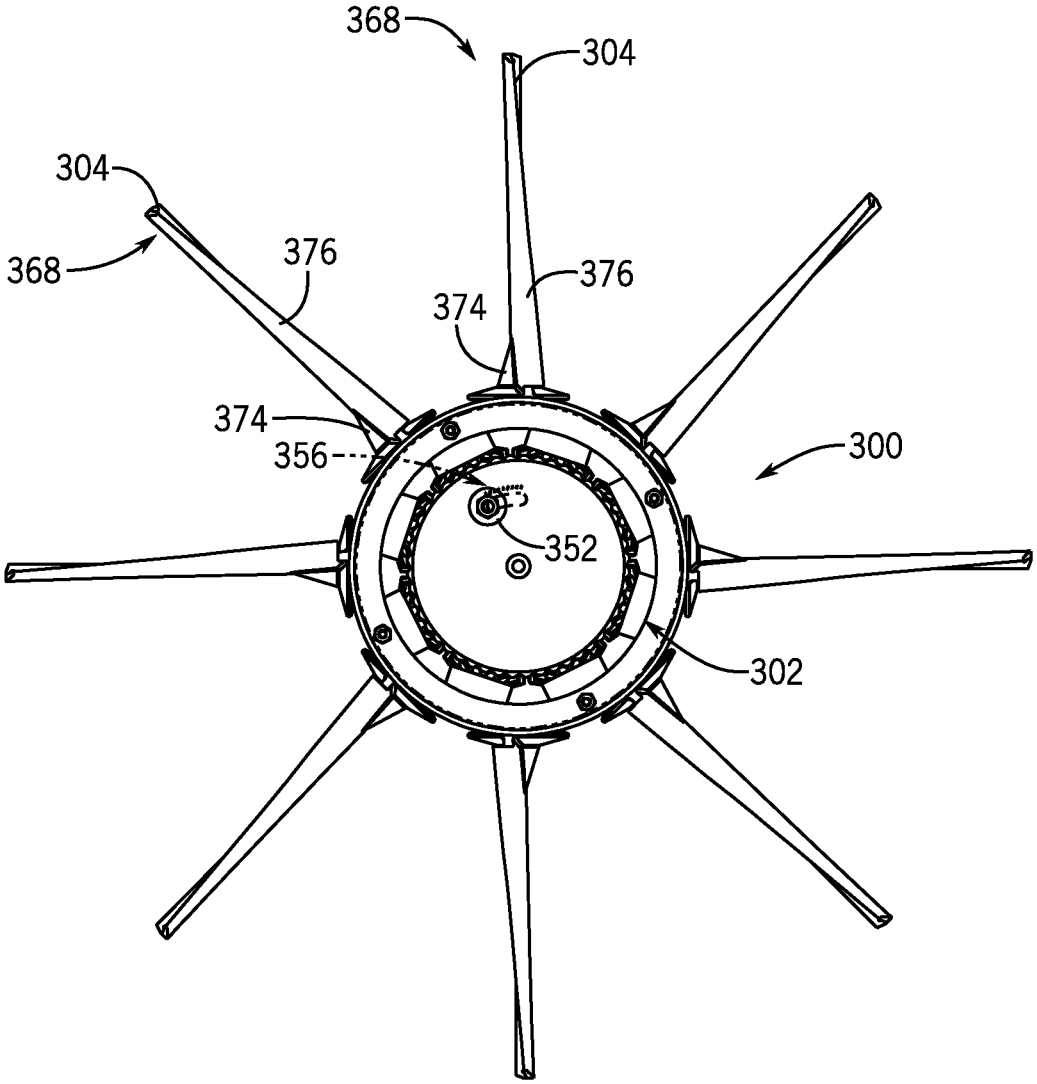
FIG. 12 is an axial view of an embodiment of a fan assembly having fan blades positioned in high pitch positions, in accordance with an aspect of the present disclosure.
Figure 13:
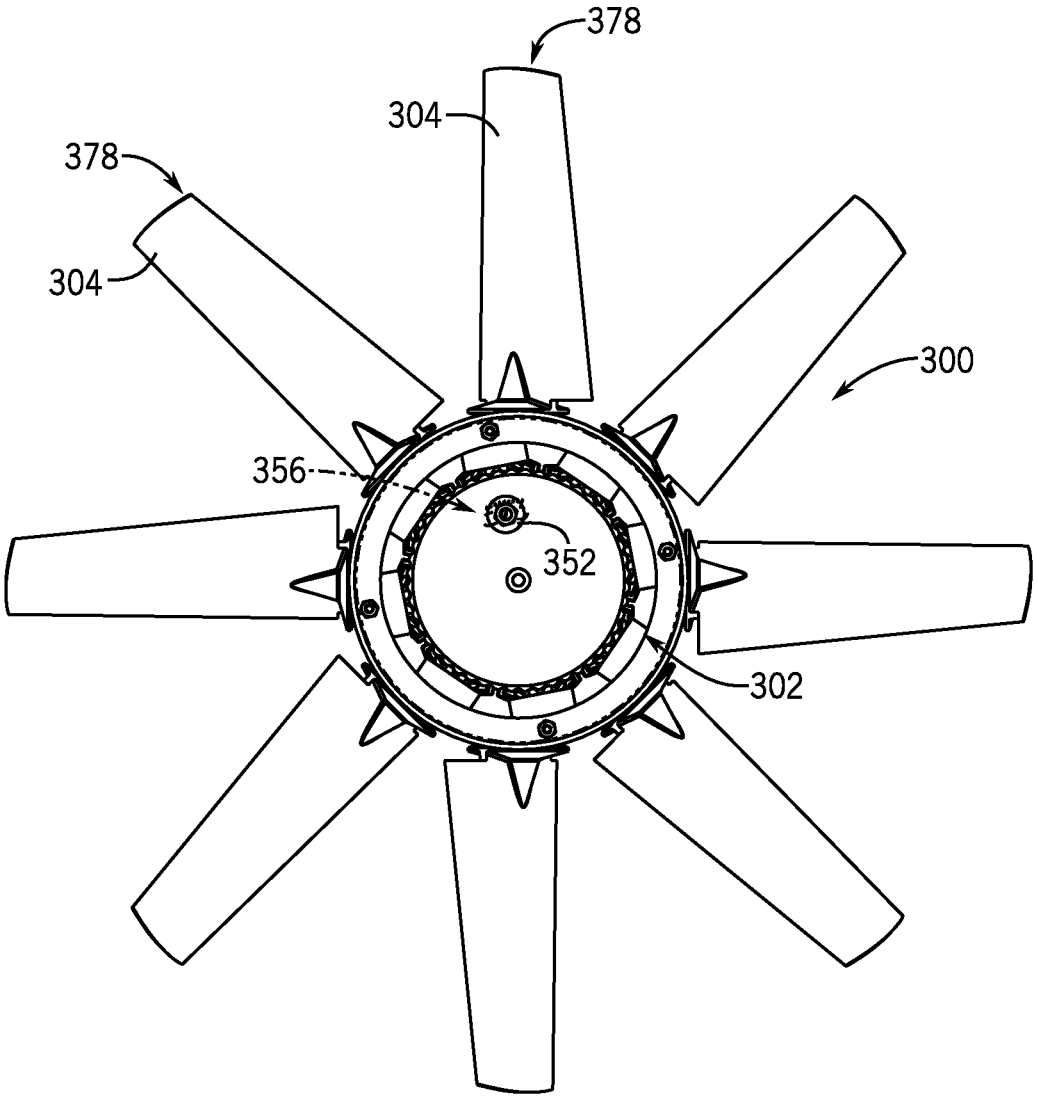
FIG. 13 is an axial view of an embodiment of a fan assembly having fan blades positioned in intermediate pitch positions, in accordance with an aspect of the present disclosure.
Figure 14:
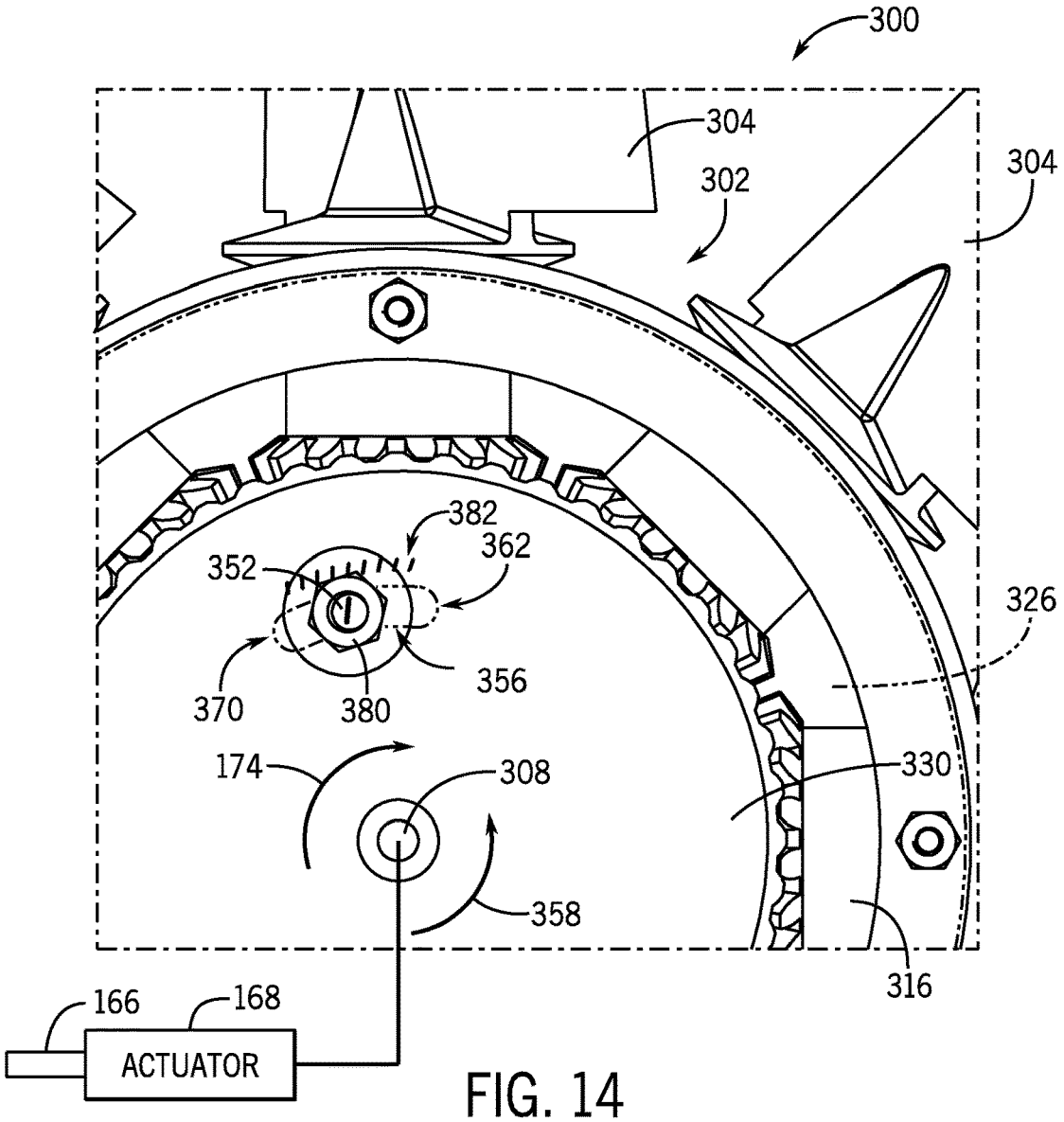
FIG. 14 in an axial view of an embodiment of a fan assembly having a pitch adjustment feature, in accordance with an aspect of the present disclosure.

To better illustrate the adjustability of the fan blades 304 provided via the gearing mechanism 302, FIGS. 11-13 are axial views of the fan assembly 300, illustrating various pitch angles of the fan blades 304 that may be achieved by positioning the adjustment feature 352 at various locations along the slot 356. FIG. 14 is a detailed axial view of the fan assembly 300, illustrating the engagement between the adjustment feature 352 and the slot 356. FIGS. 11-14 will be discussed concurrently below. To position the fan blades 304 in first pitch positions 360, such as the low pitch positions 182, the adjustment feature 352 may be translated along the slot 356 in the third rotational direction 174 to a first end 362 of the slot 356. In the first pitch positions 360, respective leading edges 364 and respective trailing edges 366 of adjacent fan blades 304 may be oriented to face toward one another. To position the fan blades 304 in second pitch positions 368, such as the high pitch positions 390, the adjustment feature 352 may be translated along the slot 356 in the fourth rotational direction 358 toward a second end 370 of the slot 356. In the second pitch positions 368, respective pressure surfaces 374 and respective suction surfaces 376 of adjacent fan blades 304 may be oriented to face toward one another. The adjustment feature 352 may be translated to any position between the first end 362 and the second end 370 of the slot 356 to position the fan blades 304 at intermediate pitch angles 378, which may be between the first pitch positions 360 and the second pitch positions 368 of the fan blades 304. Once the fan blades 304 are transitioned to appropriate pitch angles, a fastening feature 380, such as a fastening nut, may be used to tighten the adjustment feature 352 against the end cap 326. Accordingly, the fastening feature 380 may block translation movement of the adjustment feature 352 along the slot 356 to ensure that the pitch angles of the fan blades 304 are not altered during operation of the fan assembly 300.

Figure 15:
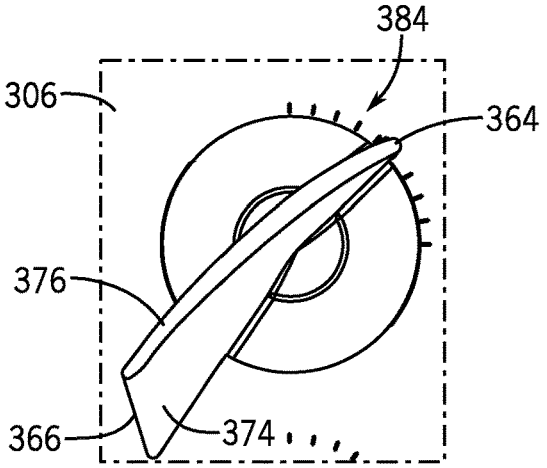
FIG. 15 is a top view of a hub ring for a fan assembly having a hub gauge, in accordance with an aspect of the present disclosure.

As shown in FIG. 14, in some embodiments, a gauge 382, such as a blade pitch angle gauge, may be printed, engraved, or otherwise marked on the end cap 326 adjacent to the slot 356. The gauge 382 may indicate the pitch angles of the fan blades 304 that are achieved by positioning the adjustment feature 352 at a particular location along the slot 356. Accordingly, the gauge 382 may enable an operator to quickly adjust the fan blades 304 to particular pitch angles without manually measuring or otherwise inspecting the pitch angles of the fan blades 304. Additionally or alternatively, the fan assembly 300 may include one or more hub gauges 384, as shown in FIG. 15, which may be marked on the hub ring 306 adjacent to respective fan blades 304. Similar to the gauge 382, the hub gauges 384 may enable the operator to determine the pitch angles of the fan blades 304 without involving manual measurement of the pitch angles through the use of dedicated tools or equipment. For example, in some embodiments, the operator may evaluate a position of the leading edge 364 of a particular fan blade 304 with respect to markings on a corresponding hub gauge 384 to determine the pitch angle of the fan blade 304 and the pitch angles of the remaining fan blades 304.

As shown in FIG. 14, in some embodiments, an actuator, such as the additional actuator 168, may be used to actuate the gearing mechanism 302 to enable automated adjustment of the pitch angles of the fan blades 304. For example, the additional actuator 168 may include a linear actuator that is coupled to the adjustment feature 352 and is configured to translate the adjustment feature 352 along the slot 356. In other embodiments, the additional actuator 168 may include an electric motor, such as stepper motor or other suitable actuator, which is coupled to a center of the ring gear 330 and is configured to rotate the ring gear 330 about the axis 308. Moreover, it should be understood that the fan assembly 300 may include the controller 200, which may be configured to operate the additional actuator 168 in accordance with the techniques discussed above to adjust the pitch angles of the fan blades 304 based on one or more operational parameters of an HVAC system having the fan assembly 300.

Figure 16:
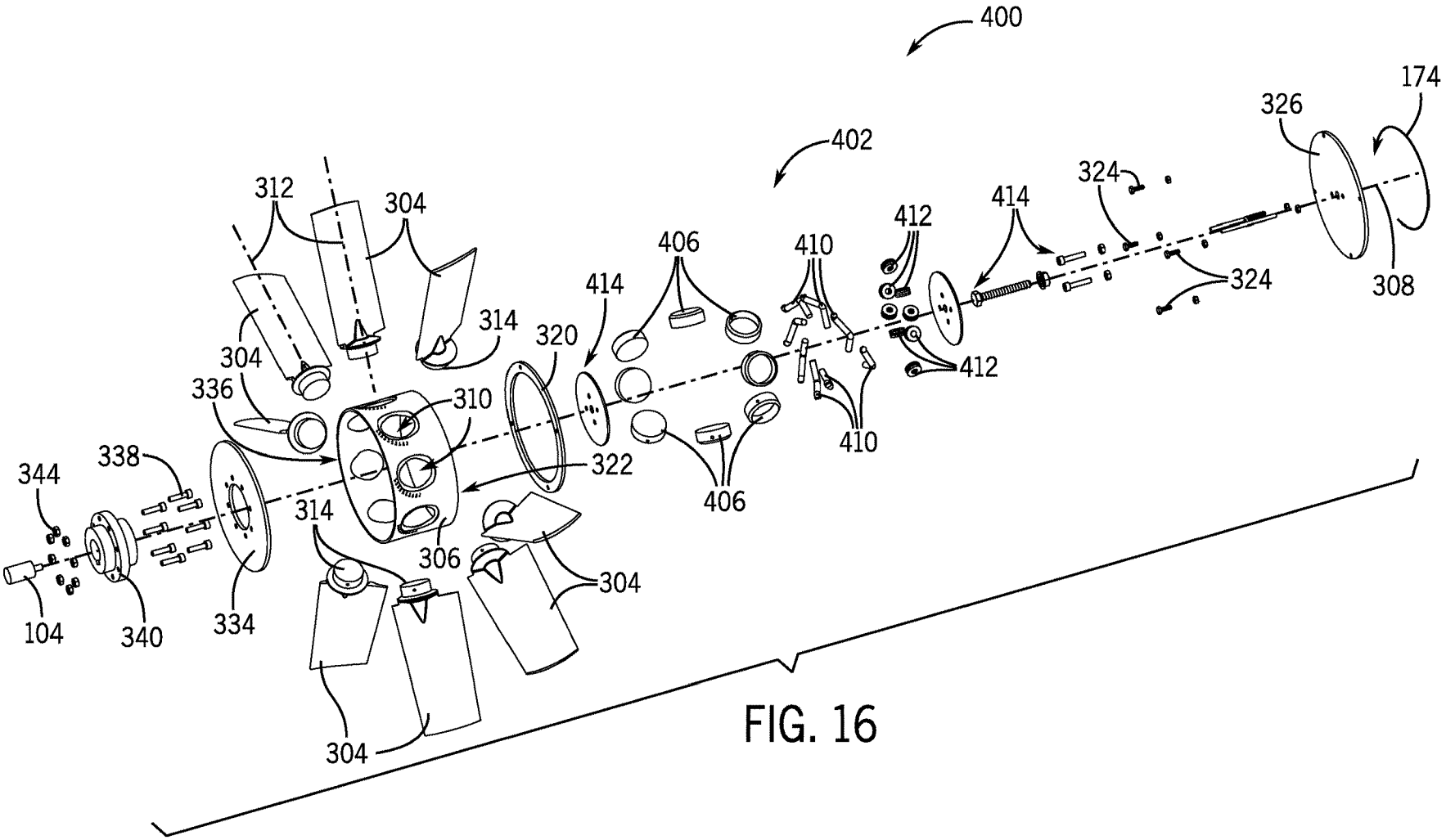
FIG. 16 is an exploded perspective view of an embodiment of a fan assembly for an HVAC system, in accordance with an aspect of the present disclosure.

FIG. 16 is an exploded perspective view of another embodiment of the fan assembly 100. In particular, the illustrated embodiment shows a fan assembly 400 having a linkage mechanism 402, which may be implemented instead of the gearing mechanism 302, which is configured to facilitate adjustment of a pitch of one or more of the fan blades 304. It should be noted that the fan assembly 400 may include some of the components of the fan assembly 300 discussed above. Accordingly, for conciseness, reference numerals associated with certain components of the fan assembly 300 may be used to identify self-similar components of the fan assembly 400 in the following discussion.

Figure 17:
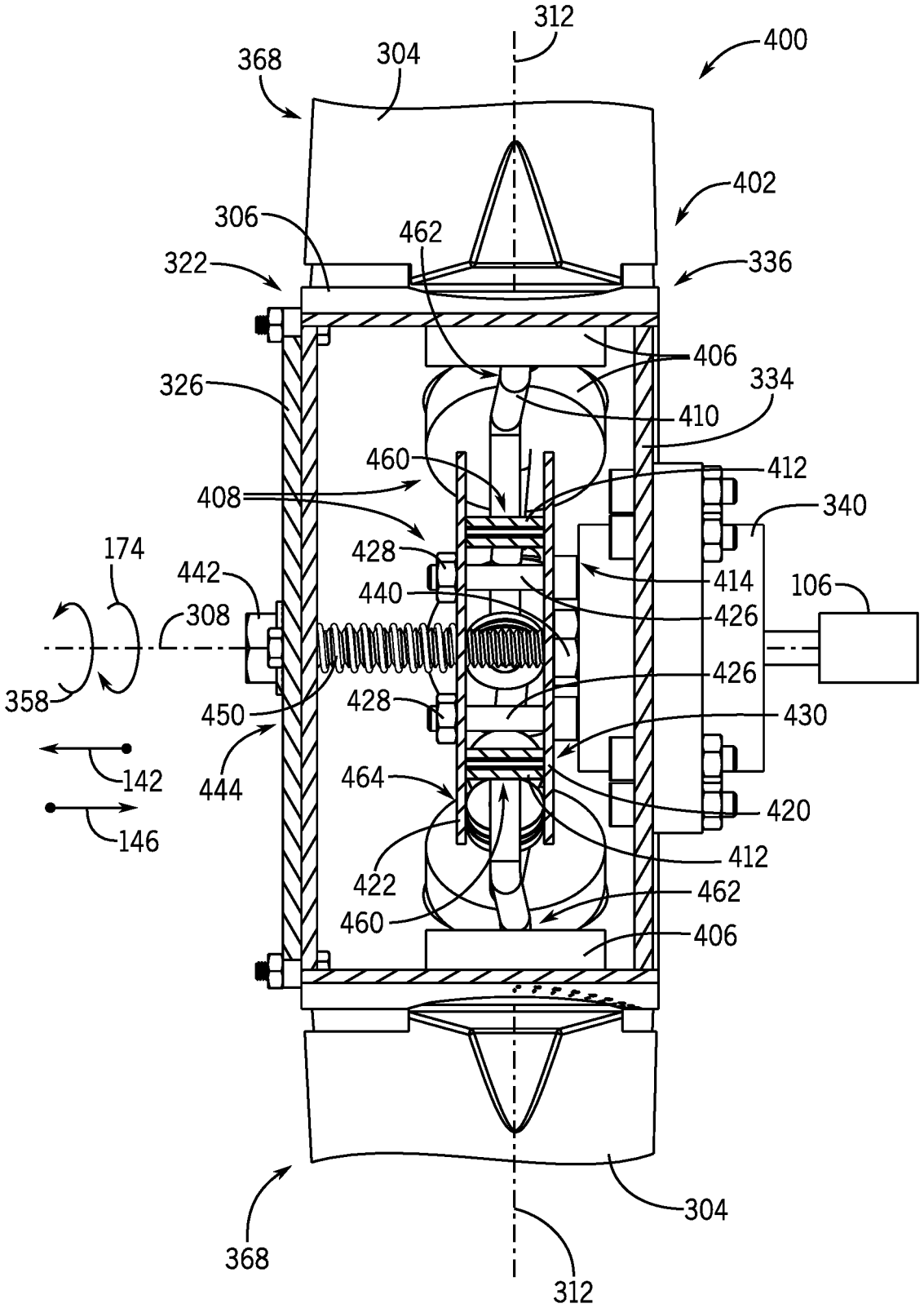
FIG. 17 is a cross-sectional side view of an embodiment of a fan assembly for an HVAC system, in accordance with an aspect of the present disclosure.

In the illustrated embodiment, the linkage mechanism 402 includes a plurality of cup retainers 406 that, in an installed configuration 408, as shown in FIG. 17, of the linkage mechanism 402, may be positioned within an interior of the hub ring 306 and may be coupled to respective shaft portions 314 of the fan blades 304. The cup retainers 406 may be coupled to the shaft portions 314 via suitable fasteners or adhesives and may facilitate rotatable coupling of the fan blades 304 to the hub ring 306. Indeed, in the installed configuration 408 of the linkage mechanism 402, the engagement between the shaft portions 314 and the cup retainers 406 may enable rotational motion of the fan blades 304 about the centerlines 312, while translational movement of the fan blades 304 along the centerlines 312 is substantially blocked.

In some embodiments, the cup retainers 406 may be rigidly coupled to ends of respective connecting rods 410 of the linkage mechanism 402. Opposing ends of the connection rods 410 may be rotatably coupled to respective bearings 412. As discussed in detail below, the connecting rods 410 and the bearings 412 are configured to facilitate conversion of linear movement, along the axis 308, of a spring assembly 414 of the linkage mechanism 402 into rotational motion, about the centerlines 312, of the cup retainers 406 and the fan blades 304.

To better illustrate the engagement between the connecting rods 410, the bearings 412, and the spring assembly 414, FIG. 17 is a cross-sectional side view of an embodiment of the fan assembly 400. As shown in the illustrated embodiment, the spring assembly 414 includes a first disc 420 and a second disc 422 that may be positioned on diametrically opposite sides of the bearings 412. The first and second discs 420, 422 may include apertures formed therein, which enable fasteners 426 to extend through the first and second discs 420, 422. Fastening nuts 428 may be applied to the fasteners 426 and used to apply a compressive force to the bearings 412 positioned or captured between the first disc 420 and the second disc 422. In the manner, the fasteners 426 and the fastening nuts 428 may ensure that the bearings 412 remain in contact with the first disc 420 and the second disc 422 during operation of the spring assembly 414. Throughout the following discussion, the first disc 420, the second disc 422, the bearings 412, the fasteners 426, and the fastening nuts 428 will be collectively referred to as a disc assembly 430.

In the illustrated embodiment, the linkage mechanism 402 includes an adjustment bolt 440 that extends through respective apertures formed within the first disc 420, the second disc 422, and the end cap 326. The adjustment bolt 440 may be coupled to the first disc 420 and/or to the second disc 422 to block rotational motion and translational movement of the adjustment bolt 440 relative to the first disc 420 and/or the second disc 422. The adjustment bolt 440 may be configured to engage with an adjustment nut 442 that is positioned on an exterior surface 444 of the end cap 326. An operator, via a wrench or other suitable tool, may rotate the adjustment nut 442 in the third rotational direction 174 or the fourth rotational direction 358 about the axis 308 to axially translate the disc assembly 430 along the axis 308. As discussed below, in this manner, the operator may adjust the pitch angles of the fan blades 304 via the engagement between the disc assembly 430 and the connecting rods 410.

Figure 18:
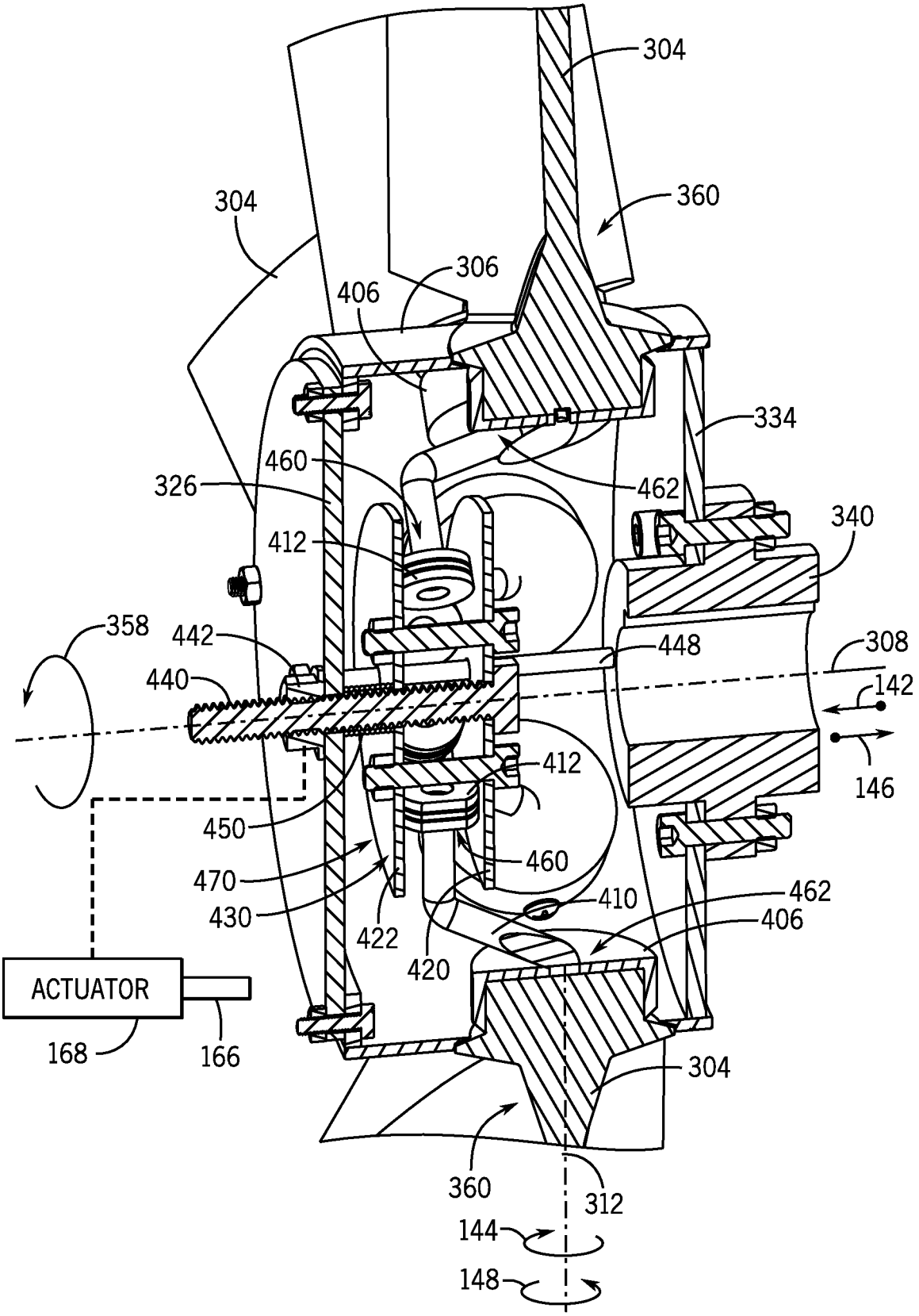
FIG. 18 is a cross-sectional perspective view of an embodiment of a fan assembly for an HVAC system, in accordance with an aspect of the present disclosure.

For example, to translate the disc assembly 430 in the first translational direction 142, the operator may rotate the adjustment nut 442 in the third rotational direction 174 to force the adjustment bolt 440 and the disc assembly 430 in the first translation direction 142. It should be understood that the linkage mechanism 402 may include one or more guide rails or pins 448, as shown in FIG. 18, which are configured to bock rotational motion of the disc assembly 430 relative to the hub ring 306 when the adjustment nut 442 is rotated relative to the adjustment bolt 440. For example, the guide rails 448 may extend through respective apertures formed within the first and second discs 420, 422 and may be coupled to the end cap 326 and/or to the adapter flange 340. Accordingly, the guide rails 448 may enable the disc assembly 430 to translate axially along the axis 308, while rotational motion of the disc assembly 430 about the axis 308 is substantially blocked. Therefore, the guide rails 448 may ensure that, when the adjustment nut 442 is rotated relative to the adjustment bolt 440, the disc assembly 430 is translated along the axis 308, instead of rotated about the axis 308.

To translate the disc assembly 430 in the second translational direction 146, the adjustment nut 442 may be rotated in the fourth rotational direction 358 relative to the adjustment bolt 440. For example, in some embodiments, the spring assembly 414 may include a prime spring 450 that extends between the end cap 326 and the second disc 422 and is configured to apply a biasing force to the disc assembly 430 in the second translational direction 146. Accordingly, when the adjustment nut 442 is rotated in the fourth rotational direction 358 to increase an axial distance between the adjustment nut 442 and a head of the adjustment bolt 440, the prime spring 450 may ensure that the disc assembly 430 is forced along the second translational direction 146.

As briefly discussed above, by translating the disc assembly 430 along the axis 308 via rotation of the adjustment nut 442, the linkage mechanism 402 may adjust the pitch angles of the fan blades 304. For example, the connecting rods 410 may include a curved profile, such as an 'S' shaped profile, which enables the connecting rods 410 to convert axial movement of respective first ends 460 of the connecting rods 410 to rotational movement of respective second ends 462 of the connecting rods 410. That is, the curved profile of the connecting rods 410 enables axial movement of the first ends 460, which are coupled to the bearings 412, to induce rotational motion to the second ends 462, which are coupled to the cup retainers 406. In some embodiments, when the adjustment bolt 440 retains the disc assembly 430 is in an extended position 464, in which the disc assembly 430 is positioned proximate to the adapter flange 340, the connecting rods 410 may be configured to orient the fan blades 304 in the second pitch positions 368. To transition the fan blades 304 from the second pitch positions 368 to the first pitch positions 360, the adjustment nut 442 may be rotated in the third rotational direction 174 relative to the adjustment bolt 440 to translate the disc assembly 430 in the first translational direction 142 along the axis 308 toward a retracted position 470, as shown in FIG. 18, in which the disc assembly 430 is positioned proximate to the end cap 326. To better illustrate and to facilitate the following discussion, FIG. 18 is a cross-sectional perspective view of the fan assembly 400 in which the disc assembly 430 is positioned in the retracted position 470.

When the disc assembly 430 is translated from the extended position 464 toward the retracted position 470, the engagement between the bearings 412 and the first and second discs 420, 422 may enable the first ends 460 of the connecting rods 410 to translate along the axis 308 in the first translational direction 142 and enable the first ends 460 to translate laterally across respective surfaces of the first and second discs 420, 422. This compound movement of the first ends 460 of the connecting rods 410 may impart rotational motion to the second ends 462 of the connecting rods 410 about the centerlines 312. Specifically, in the present example, translating the disc assembly 430 along the axis 308 in the first translational direction 142 may rotate the second ends 462 of the connecting rods 410 in the first rotational direction 144 about the centerlines 312, with respect to the hub ring 306. Conversely, translating the disc assembly 430 along the axis 308 in the second translational direction 146 may rotate the second ends 462 of the connecting rods 410 in the second rotational direction 148 about the centerlines 312, with respect to the hub ring 306. In this manner, the linkage mechanism 402 may enable adjustment of the pitch angles of the fan blades 304 via adjustment of the adjustment nut 442. It should be understood that, in other embodiments, translational movement of the disc assembly 430 along the axis 308 in the first translational direction 142 may rotate the second ends 462 of the connecting rods 410 about the centerlines 312 in the second rotational direction 148, while translational movement of the disc assembly 430 along the axis 308 in the second translational direction 146 may rotate the second ends 462 of the connecting rods 410 about the centerlines 312 in the first rotational direction 144.

It should be appreciated that, in some embodiments, an actuator, such as the additional actuator 168, may be used to translate the disc assembly 430 along the axis 308 to enable automated adjustment of the pitch angles of the fan blades 304 via the linkage mechanism 402. For example, the additional actuator 168 may be coupled to the end cap 326 and may be configured to rotate the adjustment nut 442 to translate the disc assembly 430 along the axis 308. Accordingly, the disc assembly 430 may rotate the fan blades 304 about the centerlines 312 in accordance with the techniques discussed above. In other embodiments, the additional actuator 168 may include a linear actuator that is used to facilitate adjustment of the disc assembly 430 in lieu of the adjustment bolt 440 and the adjustment nut 442. For example, in such embodiments, the additional actuator 168 may be coupled to the end cap 326, and the actuating member 166 may be coupled to the disc assembly 430. Accordingly, the additional actuator 168 may translate the disc assembly 430 along the axis 308 via movement of the actuating member 166. Moreover, it should be understood that the fan assembly 400 may also include the controller 200, which may be configured to operate the additional actuator 168 to adjust the pitch angles of the fan blades 304 in accordance with the techniques discussed above.

Figure 19:
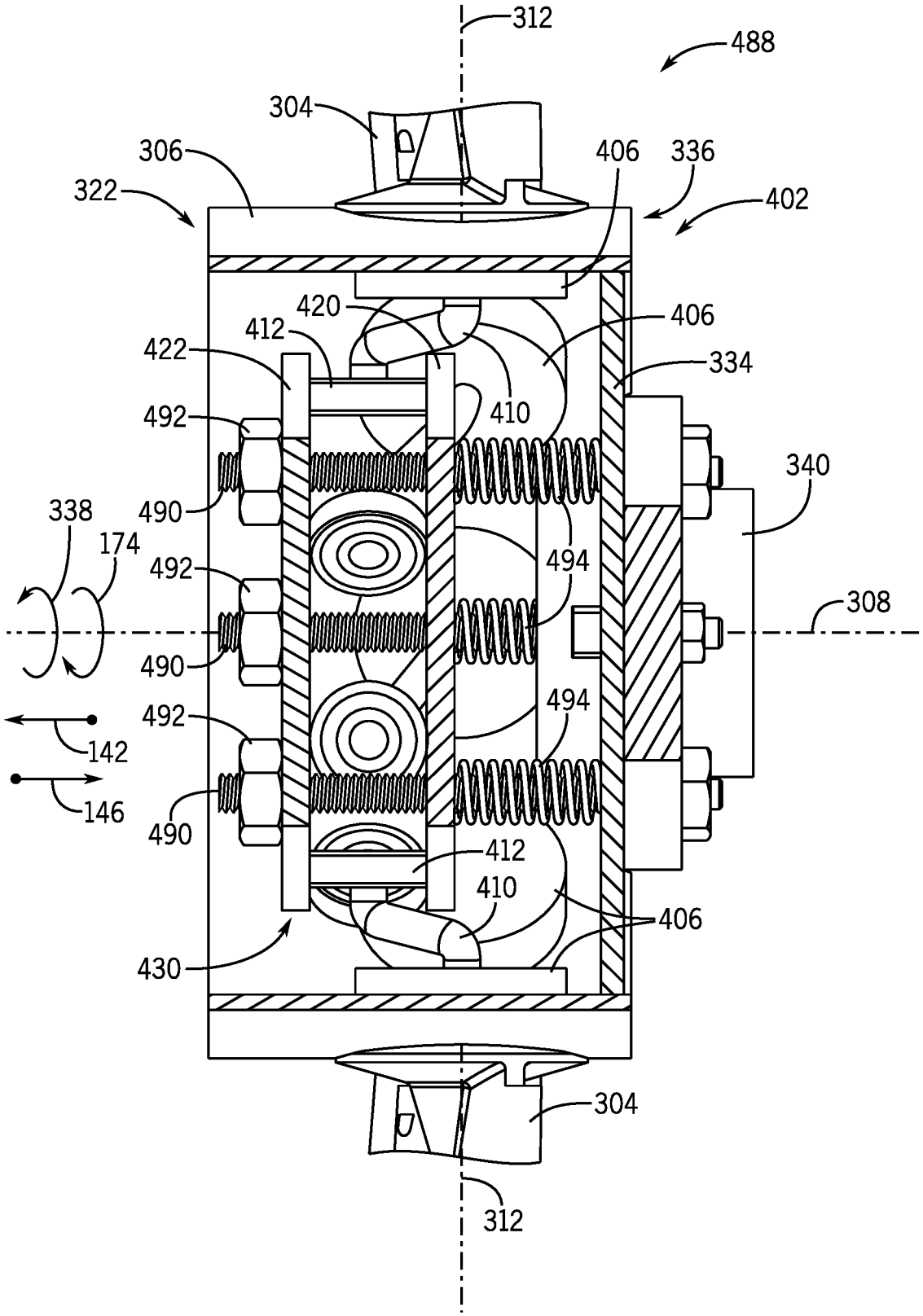
FIG. 19 is a cross-sectional side view of an embodiment of a fan assembly for an HVAC system, in accordance with an aspect of the present disclosure.

FIG. 19 is a cross-sectional side view of another embodiment of the fan assembly 400. In particular, in the illustrated embodiment shows a fan assembly 488 in which the linkage mechanism 402 includes a plurality of adjustment fasteners or bolts 490 and a plurality of adjustments nuts 492 instead of the adjustment fastener 440 and the adjustment nut 442 included in the fan assembly 400. The adjustment fasteners 490 may extend through respective apertures formed within the adapter flange 340, the inner hub plate 334, the first disc 420, and the second disc 422. Accordingly, the adjustment fasteners 490 may support the disc assembly 430 within the hub ring 306, such that the guide rails 448 may be omitted from the linkage mechanism 402. Indeed, because the illustrated embodiment of the linkage mechanism 402 includes multiple adjustment fasteners 490, the adjustment fasteners 490 may cooperate to block rotational motion of the disc assembly 430 about the axis 308 relative to the hub ring 306.

As shown in the illustrated embodiment, a respective spring 494 may be disposed about each of the adjustment fasteners 490 and positioned between the first disc 420 and the inner hub plate 334. Accordingly, the springs 494 may be configured to apply a compressive force between the disc assembly 430 and the adjustment nuts 492. As such, the fan assembly 488 may be operable to adjust the pitch of the fan blades 304 in a similar manner to the fan assembly 400 discussed above. That is, the adjustment nuts 492 may be rotated in the third rotational direction 174, relative to the adjustment fasteners 490, to translate the disc assembly 430 in the second translational direction 146. Conversely, the adjustment nuts 492 may be rotated in the fourth rotational direction 358, relative to the adjustment fasteners 490, to translate the disc assembly 430 in the first translational direction 142. In this manner, the disc assembly 430 may, via the engagement with the connecting rods 410, induce rotational motion of the fan blades 304 about the centerlines 312.

Figure 20:
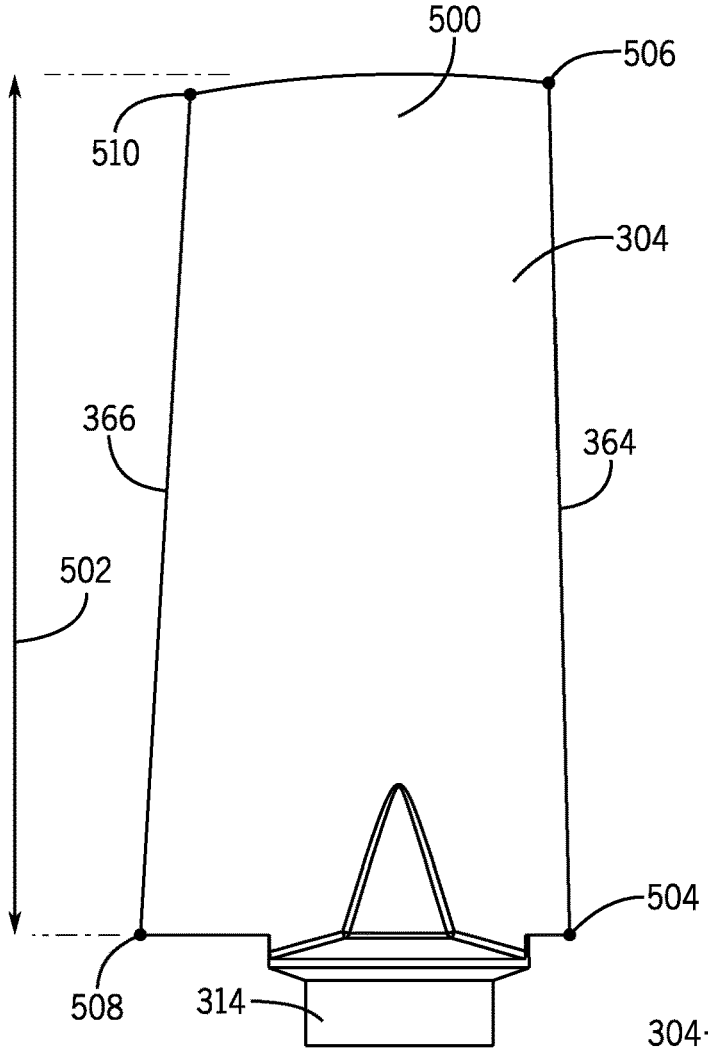
FIG. 20 is a side view of an embodiment of a fan blade for a fan assembly, in accordance with an aspect of the present disclosure.
Figure 21:
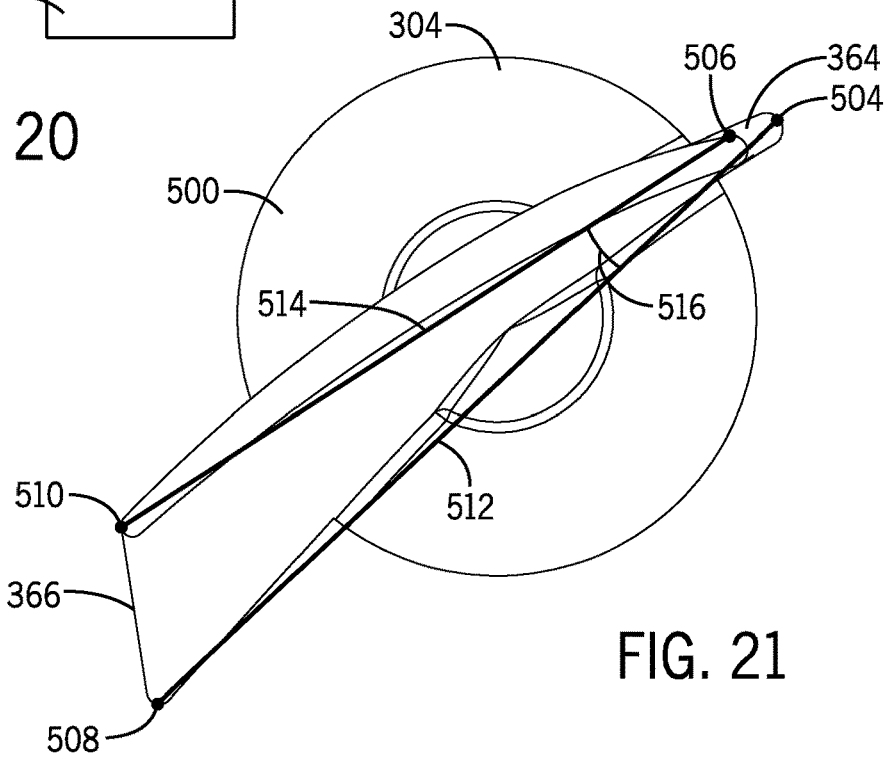
FIG. 21 is an axial view of an embodiment of a fan blade for a fan assembly, in accordance with an aspect of the present disclosure.
Figure 23:
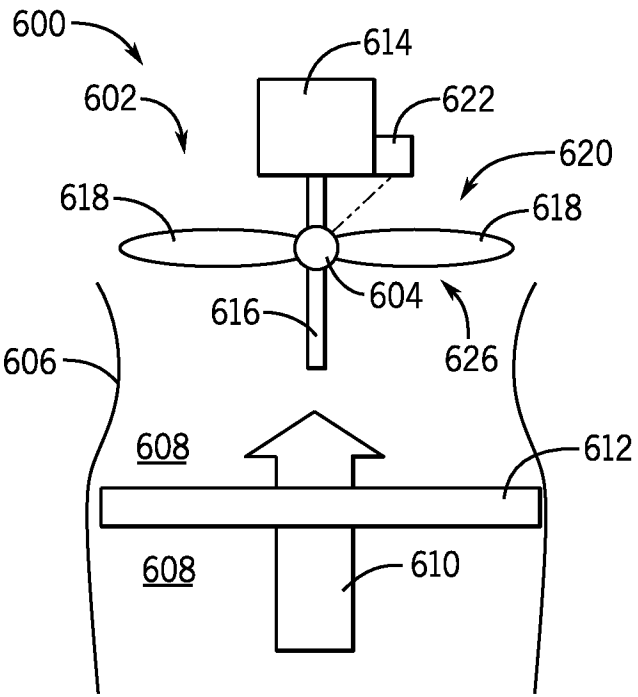
FIG. 23 is a schematic of an embodiment of a fan assembly for an HVAC system, in accordance with an aspect of the present disclosure.

FIG. 20 is a side view of an embodiment of one of the fan blades 304. In particular, FIG. 20 shows a fan blade 500 having a variable pitch profile. FIG. 21 is an axial view of an embodiment of the fan blade 500. FIGS. 20 and 21 will be discussed concurrently below. In some embodiments, a pitch of the fan blade 500 may vary along a length 502 of the fan blade 500. For example, the fan blade 500 may include a radially inner leading vertex 504 and a radially outer leading vertex 506 that are positioned on the leading edge 364 of the fan blade 500. The fan blade 500 may include a radially inner trailing vertex 508 and a radially outer trailing vertex 510 that are positioned on the trailing edge 366 of the fan blade 500. As shown in FIG. 21, a first chord 512 extending between the radially inner leading vertex 504 and the radially inner trailing vertex 508 may be offset from a second chord 514 extending between the radially outer leading vertex 506 and the radially outer trailing vertex 510 by an angle 516. Accordingly, the fan blade 500 may include a variable blade pitch profile that varies along the length 502 of the fan blade 500 by the angle 516.

Figure 22:
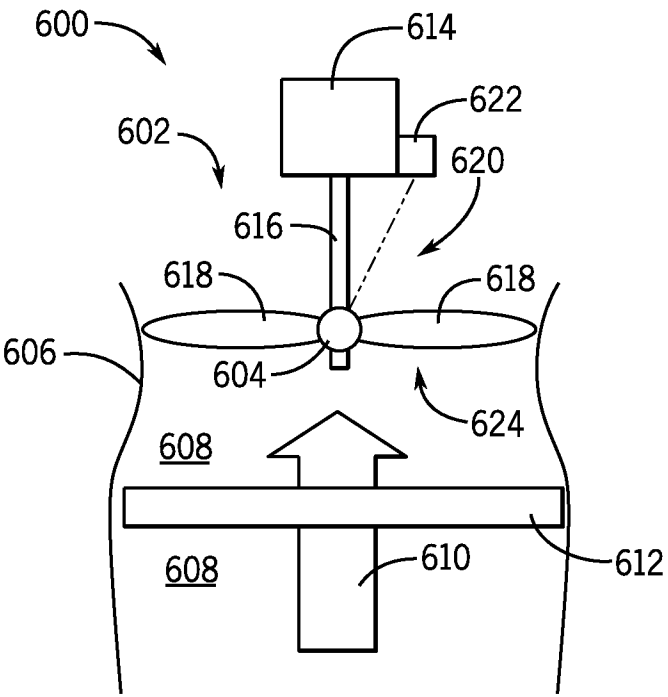
FIG. 22 is a schematic of an embodiment of a fan assembly for an HVAC system, in accordance with an aspect of the present disclosure.

FIG. 22 is a schematic of an embodiment of a heat exchange assembly 600 having a fan assembly 602 that includes a translatable fan hub 604. The fan assembly 602 may include any of the fan assemblies 100, 300, 400, 488 discussed above. As shown in the illustrated embodiment, the heat exchange assembly 600 includes a duct 606, shroud, or other structure that defines a flow path 608. The fan assembly 602 is configured to draw a flow of ambient air 610 along the flow path 608 and across a heat exchanger 612, such as the condenser 76 or the evaporator 80, which may be positioned within the flow path 608. For example, the fan assembly 602 may include an actuator 614, such as an electric motor, which is configured to drive rotation of the translatable fan hub 604 via a shaft 616. A plurality of fan blades 618 may extend radially from the translatable fan hub 604, such that rotation of the shaft 616 imparts rotation to the fan blades 618. Accordingly, such rotation of the fan blades 618 enables the fan assembly 602 to draw the ambient air 610 across the heat exchanger 612. The fan blades 618 and the translatable fan hub 604 will be collectively referred to as a fan 620 throughout the following discussion.

In some embodiments, the fan assembly 602 may include an additional actuator 622 that is configured to move the translatable fan hub 604, and thus the fan 620, along a length of the shaft 616. In particular, the additional actuator 622 may be configured to translate the fan 620 between an extended position 624, in which the fan 620 may be positioned within the duct 606, and a retracted position 626, as shown in FIG. 21, in which the fan 620 is extracted or removed from the duct 606 or is partially extracted from the duct 606. In some embodiments, a position of the fan 620 within the duct 606 may determine a flow rate of the ambient air 610 that is drawn across the heat exchanger 612 by the fan 620 at a particular rotational speed of the fan 620. For example, in the extended position 624, at a particular operational speed, the fan 620 may generate a relatively large pressure differential across the heat exchanger 612, such that a flow rate of the ambient air 610 forced across the heat exchanger 612 is relatively high. Conversely, in the retracted position 626, at the same operational speed, the fan 620 may generate a relatively small pressure differential across the heat exchanger 612, such that a flow rate of the ambient air 610 forced across the heat exchanger 612 is relatively low. Accordingly, by translating the fan 620 along the shaft 616, the additional actuator 622 may be used to adjust a flow rate of the ambient air 610 drawn across the heat exchanger 612 without adjusting a rotational speed of the shaft 616. As such, the additional actuator 622 may be used to modulate an air flow rate across the heat exchanger 612 in embodiments where, for example, the actuator 614 is an inexpensive single speed actuator, which may be configured to rotate the shaft 616 at a particular or fixed operational speed. Indeed, the additional actuator 622 may enable variable air flow rates across the heat exchanger 612 without involving use of an expensive variable frequency drive for adjustment of the operational speed of the actuator 614.

As set forth above, embodiments of the present disclosure may provide one or more technical effects useful for enabling adjustability of an air flow rate generated by a fan without involving use of a variable frequency drive (VFD) or other device to adjust an operational speed of the fan. Indeed, the fan assemblies discussed herein enable adjustability in an air flow rate generated by fans while an operational speed of the fans may remain constant. Accordingly, the fan assemblies set forth above may enable such fans to generate various air flow rates without involving use of a relatively expensive VFD, which may reduce installation, operation, and/or maintenance costs associated with an HVAC system having the fan assemblies. It should be understood that the technical effects and technical problems in the specification are examples and are not limiting. Indeed, it should be noted that the embodiments described in the specification may have other technical effects and can solve other technical problems.

While only certain features and embodiments of the present disclosure have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the present disclosure. Furthermore, in an effort to provide a concise description of the exemplary embodiments, all features of an actual implementation may not have been described, such as those unrelated to the presently contemplated best mode of carrying out the present disclosure, or those unrelated to enabling the claimed embodiments. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A fan assembly for a heating, ventilation, and/or air conditioning (HVAC) unit, comprising:

a hub having a fan blade extending therefrom;

a fan pitch adjuster configured to engage the fan blade and adjust a pitch of the fan blade relative to the hub in response to movement of the fan pitch adjuster relative to the hub;

a motor shaft coupled to the fan pitch adjuster and to the hub, wherein the motor shaft is configured to drive rotation of the fan pitch adjuster and the hub; and an actuator coupled to the fan pitch adjuster and configured to axially move the fan pitch adjuster along an axial length of the motor shaft and relative to the hub to adjust the pitch of the fan blade.

2. The fan assembly of claim 1, wherein the fan blade includes a first gear, the fan pitch adjuster includes a second gear engaged with the first gear, and wherein the fan pitch adjuster is configured to convert an axial movement of the actuator into rotational movement of the fan blade via engagement between the first gear and the second gear.

3. The fan assembly of claim 2, wherein the first gear is a pinion, and the second gear is a rack.

4. The fan assembly of claim 2, wherein the fan pitch adjuster includes an assembly of a first plate extending about the motor shaft and configured to rotate with the motor shaft and a second plate extending about the motor shaft, wherein the second plate is rotationally stationary, the second gear is coupled to the first plate, and the first plate and the second plate are configured to translate axially along the motor shaft via operation of the actuator.

5. The fan assembly of claim 4, comprising a bearing disposed about the motor shaft and disposed radially between the first plate and the second plate.

6. The fan assembly of claim 4, comprising a third plate disposed about the motor shaft and adjacent to the first plate and the second plate, wherein the actuator includes an actuating member fixed to the third plate to drive axial movement of the first plate, the second plate, and the third plate along the motor shaft.

7. The fan assembly of claim 1, wherein the fan pitch adjuster engages a gear of the fan blade within the hub.

8. The fan assembly of claim 1, comprising a motor configured to induce rotation of the motor shaft such that the motor shaft drives rotation of the fan pitch adjuster and the hub.

9. The fan assembly of claim 8, wherein the motor and the actuator are coupled to one another.

10. The fan assembly of claim 9, wherein a housing of the actuator is stationary relative to a housing of the motor.

11. The fan assembly of claim 1, wherein the actuator is a linear actuator.

12. The fan assembly of claim 1, comprising a controller communicatively coupled to the actuator and to a sensor configured to acquire feedback indicative of an operational parameter of the HVAC unit, wherein the controller is configured to instruct the actuator to axially move the fan pitch adjuster along the motor shaft based on the feedback.

13. A fan assembly for a heating, ventilation, and/or air conditioning (HVAC) unit, comprising:

a hub having a rotational axis and a fan blade extending from the hub;

a motor shaft coupled to the hub and configured to drive rotation of the hub about the rotational axis;

a fan pitch adjuster disposed about an axial length of the motor shaft and configured to engage with the fan blade to adjust a pitch of the fan blade relative to the hub in response to movement of the fan pitch adjuster along the motor shaft; and an actuator coupled to the fan pitch adjuster and configured to drive the fan pitch adjuster along the axial length of the motor shaft to adjust the pitch of the fan blade.

14. The fan assembly of claim 13, wherein the fan blade is coupled to a first gear, and the fan pitch adjuster includes a second gear engaged with the first gear, wherein movement of the fan pitch adjuster along the motor shaft is configured to cause rotational motion of the fan blade relative to the hub via engagement between the first gear and the second gear.

15. The fan assembly of claim 14, wherein the first gear and the second gear are positioned inside the hub.

16. The fan assembly of claim 14, wherein the fan pitch adjuster includes a first plate and a second plate rotatably coupled to one another, wherein the first plate includes the second gear and is configured to rotate with the motor shaft and the hub relative to the second plate.

17. The fan assembly of claim 16, wherein the actuator is coupled to the second plate and is configured to translate the first plate and the second plate along the motor shaft.

18. The fan assembly of claim 16, wherein the first plate includes a protrusion extending from the first plate and positioned within an aperture formed within the second plate, wherein a bearing is positioned within the aperture between the protrusion and the second plate to rotatably couple to the first plate to the second plate.

19. The fan assembly of claim 13, comprising a motor configured to drive rotation of the motor shaft, wherein a housing of the actuator is rotationally stationary relative to a housing of the motor.

20. The fan assembly of claim 13, comprising a controller communicatively coupled to the actuator and configured to instruct the actuator to axially move the fan pitch adjuster along the motor shaft based on an operating parameter of the HVAC unit.

21. A fan assembly for a heating, ventilation, and/or air conditioning (HVAC) unit, comprising:

a hub;

a fan blade rotationally coupled to the hub and extending from a rotational axis of the hub;

a motor shaft coupled to the hub and configured to drive rotation of the hub about the rotational axis;

a fan pitch adjuster engaged with the fan blade and configured to translate along the motor shaft, wherein the fan pitch adjuster is configured to rotate the fan blade relative to the hub in response to movement of the fan pitch adjuster along the motor shaft such that a pitch of the fan blade is adjusted; and an actuator coupled to the fan pitch adjuster and configured to induce the movement of the fan pitch adjuster along an axial length of the motor shaft.

22. The fan assembly of claim 21, comprising a motor having the motor shaft and a housing, wherein the motor shaft extends from the housing to the hub, and the fan pitch adjuster is disposed about the motor shaft between the hub and the housing.

23. The fan assembly of claim 21, wherein the fan blade is coupled to a pinion, the fan pitch adjuster includes a rack, and the pinion is configured to engage with the rack such that movement of the fan pitch adjuster along the motor shaft induces rotational movement of the fan blade about a fan blade axis and relative to the hub to adjust the pitch of the fan blade.

24. The fan assembly of claim 21, wherein the hub and the motor shaft are configured to rotate relative to the actuator.

25. The fan assembly of claim 21, comprising:

a motor configured to drive rotation of the motor shaft about the rotational axis at a fixed operational speed; and a controller communicatively coupled to the actuator and including a sensor configured to provide feedback indicative of an operational parameter of the HVAC unit, wherein the controller is configured to instruct the actuator to adjust the pitch of the fan blade via the fan pitch adjuster to increase or decrease an air flow rate generated by the fan assembly at the fixed operational speed based on the feedback.

* * * * *